US007328748B2

(12) United States Patent
Giacomino

(10) Patent No.: US 7,328,748 B2
(45) Date of Patent: Feb. 12, 2008

(54) THERMAL ACTUATED PLUNGER

(75) Inventor: Jeffrey L. Giacomino, Fort Lupton, CO (US)

(73) Assignee: Production Control Services, Inc., Frederick, CO (US)

( * ) Notice: Subject to any disclaimer, the term of this patent is extended or adjusted under 35 U.S.C. 154(b) by 296 days.

(21) Appl. No.: 11/071,148

(22) Filed: Mar. 3, 2005

(65) Prior Publication Data

US 2005/0194149 A1 Sep. 8, 2005

Related U.S. Application Data

(60) Provisional application No. 60/549,814, filed on Mar. 3, 2004.

(51) Int. Cl.
*E21B 43/00* (2006.01)
*E21B 47/00* (2006.01)

(52) U.S. Cl. ..... 166/369; 166/250.01; 166/105

(58) Field of Classification Search ..... None
See application file for complete search history.

(56) References Cited

U.S. PATENT DOCUMENTS

| | | | | |
|---|---|---|---|---|
| 2,714,855 | A | 8/1955 | Brown | 103/52 |
| 3,181,470 | A | 5/1965 | Clingman | |
| 4,275,790 | A | 6/1981 | Abercrombie | |
| 4,502,843 | A | 3/1985 | Martin | 417/56 |
| 4,712,981 | A | 12/1987 | Gramling | |
| 5,253,713 | A | 10/1993 | Gregg et al. | |
| 5,333,684 | A | 8/1994 | Walter et al. | 166/54 |
| 5,632,297 | A * | 5/1997 | Sciullo et al. | 137/73 |
| 5,868,554 | A | 2/1999 | Giacomino et al. | |
| 5,967,410 | A * | 10/1999 | Lammers | 236/93 R |

(Continued)

FOREIGN PATENT DOCUMENTS

CA 2 428 618 A1 11/2004

(Continued)

OTHER PUBLICATIONS

Bruce M. Victor, "Variable Orifice Bypass Plunger", U.S. Appl. No. 11/110,447, filed Apr. 20, 2005; complete copy of specification, drawings, and filing receipt attached hereto.

(Continued)

*Primary Examiner*—Frank Tsay
(74) *Attorney, Agent, or Firm*—Aileen Law; A Law Firm, P.C.

(57) ABSTRACT

A downhole plunger for a gas/oil well comprises a valve to regulate fluid flow past the plunger and a thermal actuator to control the valve. The thermal actuator of the disclosed device enables the valve to open and close aperatures without relying on the physical impact generally required of mechanical valve bypass plungers. In addition, the thermal actuator provides for a brake to reduce a plunger's travel rate as it approaches the bottom or top of a well. The thermal actuator partially opens aperatures to slow a plunger down as it approaches the top of a well. Likewise, the thermal actuator partially closes aperatures to slow the plunger as it approaches the well bottom. A thermally actuated plunger comprising an expandable outer diameter is disclosed, as is a plunger in combination with a data logger and a thermal activated brake.

38 Claims, 23 Drawing Sheets

U.S. PATENT DOCUMENTS

| | | | | |
|---|---|---|---|---|
| 6,148,923 | A | 11/2000 | Casey | 166/372 |
| 6,176,309 | B1 | 1/2001 | Bender | 166/68 |
| 6,241,028 | B1 | 6/2001 | Bijleveld et al. | 175/40 |
| 6,273,690 | B1 | 8/2001 | Fischer, Jr. et al. | 417/555.2 |
| 6,554,580 | B1 | 4/2003 | Mayfield et al. | |
| 6,591,737 | B2 | 7/2003 | Giacomino | |
| 6,637,510 | B2 | 10/2003 | Lee | 166/108 |
| 6,669,449 | B2 | 12/2003 | Giacomino | |
| 6,705,404 | B2 | 3/2004 | Bosley | 166/372 |
| 6,725,916 | B2 | 4/2004 | Gray et al. | |
| 6,746,213 | B2 | 6/2004 | Giacomino | |
| 6,854,953 | B2 * | 2/2005 | Van Drentham-Susman et al. | 415/36 |
| 6,907,926 | B2 | 6/2005 | Bosley | 166/108 |
| 6,935,427 | B1 | 8/2005 | Billingsley | |
| 6,945,762 | B2 | 9/2005 | Williams | 417/546 |
| 7,134,503 | B2 | 11/2006 | Lee | |
| 2003/0141051 | A1 | 7/2003 | Abbott et al. | 166/63 |
| 2003/0215337 | A1 | 11/2003 | Lee | 417/56 |
| 2004/0129428 | A1 | 7/2004 | Kelley | 166/372 |
| 2006/0113072 | A1 | 6/2006 | Lee | |

FOREIGN PATENT DOCUMENTS

| | | |
|---|---|---|
| RU | 2225502 | 3/2004 |

OTHER PUBLICATIONS

Jeffrey L. Giacomino, "Data Logger Plunger", U.S. Appl. No. 11/060,513, filed Feb. 17, 2005; complete copy of specification, drawings, and filing receipt attached hereto.

Bruce M. Victor, U.S. Appl. No. 10/803,373, "Multi-Part Plunger" Filed Mar. 18, 2004. (No copy attached per MPEP 609.04 (a)(II)(C) because Application is stored in Image File Wrapper System.).

Bruce M. Victor, U.S. Appl. No. 11/105,753, "Saad Plunger" Filed Apr. 14, 2005. (No copy attached per MPEP 609.04 (a)(II)(C) because Application is stored in Image File Wrapper System.).

Bruce M. Victor, U.S. Appl. No. 11/010,168, "Internal Shock Absorber Bypass Plunger" Filed Dec. 10, 2004. (No copy attached per MPEP 609.04 (a)(II)(C) because Application is stored in Image File Wrapper System.).

* cited by examiner

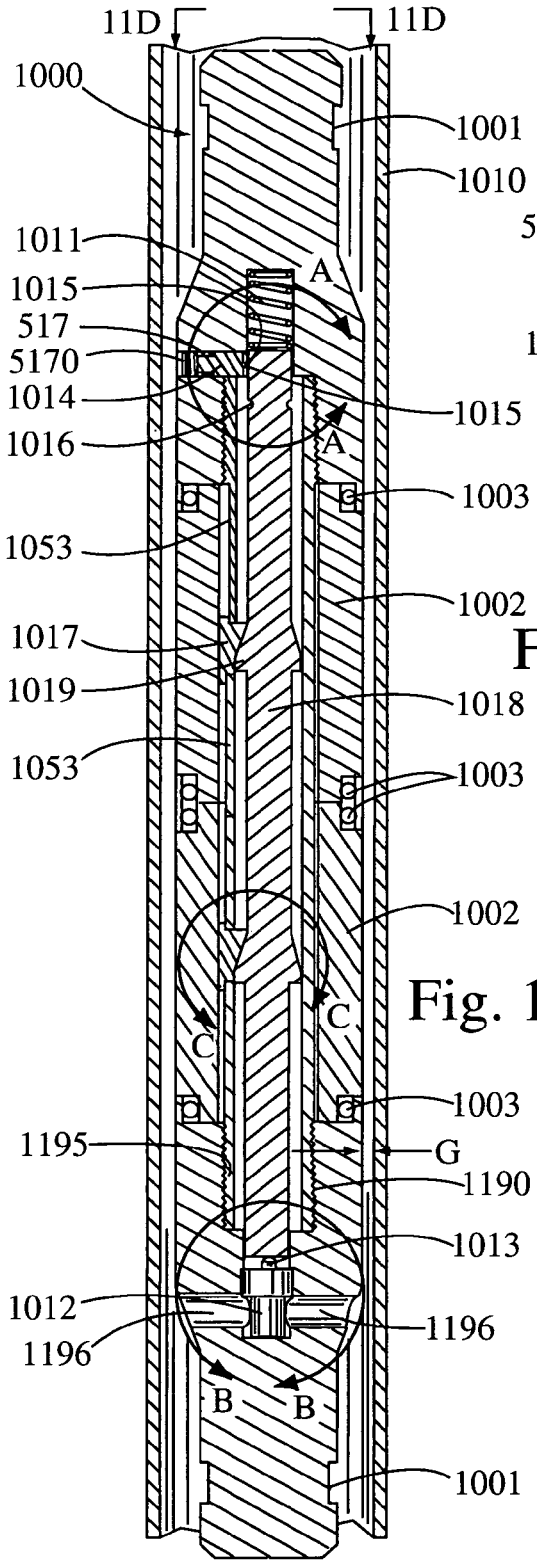
Fig. 11
Fig. 11A
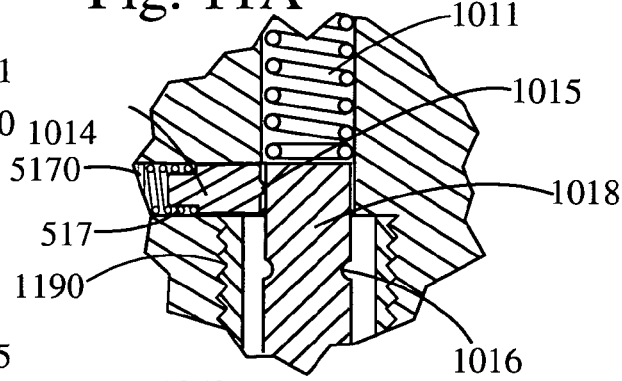
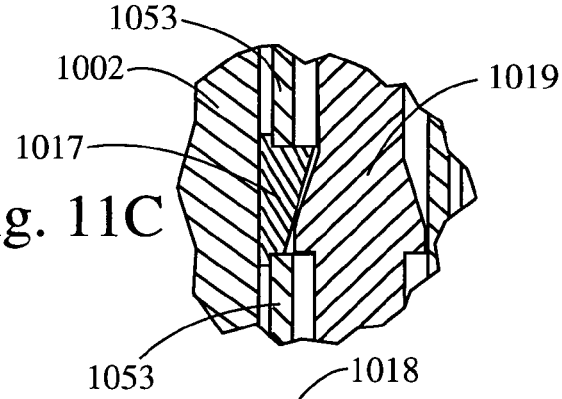
Fig. 11C
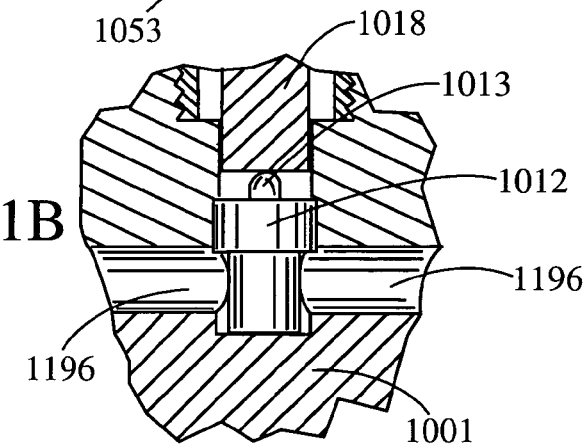
Fig. 11B
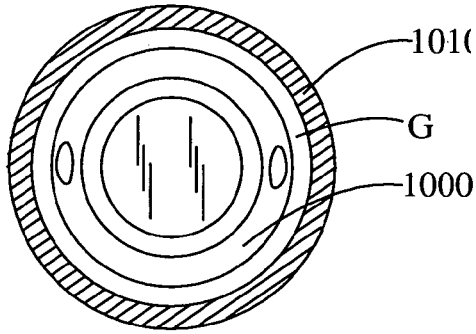
Fig. 11D

THERMAL ACTUATED PLUNGER

CROSS REFERENCE APPLICATIONS

This application is a non-provisional application claiming the benefits of provisional application No. 60/549,814 filed Mar. 3, 2004.

FIELD OF THE INVENTION

The present invention relates to plunger lift apparatus for the lifting of formation liquids in a hydrocarbon well. The plunger comprises a thermal actuated valve encased in the plunger which reacts to downhole heat to open and close apertures, thereby slowing a rate of travel of the plunger apparatus to protect the apparatus at the bottom and top of the well.

BACKGROUND OF THE INVENTION

A plunger lift is an apparatus that is used to increase the productivity of oil and gas wells. As today's companies implement cost containment and resource allocation measures in response to lower product prices, the use of a plunger lift production method should be considered because it can be one of the most economical methods of production. Large returns are possible from a relatively small capital expenditure. This is particularly true for marginal wells.

The cost-effectiveness of plunger lift methodology can be characterized by at least three features: low initial costs, low annual maintenance costs, and the ability to better utilize other field assets. The benefits of these features are lower overall costs and lower unit production costs.

A typical plunger lift application can cost less than $5,000 per installation as compared to $20,000 to $40,000 for beam lift. Plunger lift costs typically do not increase with well depth and annual maintenance costs can range from $500 to $1,000 versus $5,000 to $10,000 for beam lift.

Other benefits can include: better utilization of an operator's time, reduction of environmental liability concerns from not venting hydrocarbons into the atmosphere (blowing), and applications are not typically limited by depth. Although systems have been successfully installed on wells as deep as 26,000 feet, even greater depths may be achieved.

There are five common applications for plunger lifts: 1). gas well liquid unloading; 2). oil production with associated gas; 3). gas wells with coiled tubing; 4). control scale and paraffin; and 5). intermittent gas lift.

In the early stages of a well's life, liquid loading is usually not a problem. When rates are high, the well liquids are carried out of the tubing by the high velocity gas. As a well declines, a critical velocity is reached below which the heavier liquids do not make it to the surface and start to fall back to the bottom exerting back pressure on the formation, thus loading up the well. A plunger system is a method of unloading gas in high ratio oil wells without interrupting production. In operation, the plunger travels to the bottom of the well where the loading fluid is picked up by the plunger and is brought to the surface removing all liquids in the tubing. The plunger also keeps the tubing free of paraffin, salt or scale build-up. A plunger lift system works by cycling a well open and closed. During the open time a plunger interfaces between a liquid slug and gas. The gas below the plunger will push the plunger and liquid to the surface. This removal of the liquid from the tubing bore allows an additional volume of gas to flow from a producing well. A plunger lift requires sufficient gas presence within the well to be functional in driving the system. Oil wells making no gas are thus not plunger lift candidates.

As flow rate and pressures decline in a well, lifting efficiency can decline. Before long the well could begin to "load up". This is a condition whereby the gas being produced by the formation can no longer carry the liquid being produced to the surface. There are two reasons this occurs. First, as liquid comes in contact with the wall of the production string of tubing, friction occurs. The velocity of the liquid is slowed and some of the liquid adheres to the tubing wall, creating a film of liquid on the tubing wall. This liquid may not reach the surface. Secondly, as the flow velocity continues to slow the gas phase may no longer support liquid in either slug form or droplet form. This liquid along with the liquid film on the sides of the tubing, may fall back to the bottom of the well. In a very aggravated situation, there could be liquid in the bottom of the well with only a small amount of gas being produced at the surface. The produced gas must bubble through the liquid at the bottom of the well and then flow to the surface. Because of the low velocity, very little liquid, if any, is carried to the surface by the gas. A plunger lift will act to remove the accumulated liquid, thereby improving well efficiency.

A typical installation plunger lift system 100 can be seen in FIG. 1. A lubricator assembly 10 is one of the most important components of plunger system 100. Lubricator assembly 10 includes a cap 1, an integral top bumper spring 2, a striking pad 3, and an extracting rod 4. Extracting rod 4 may or may not be employed depending on the plunger type. Below lubricator assembly 10 is a plunger auto catching device 5 and a plunger sensing device 6. Sensing device 6 sends a signal to a surface controller 15 upon the arrival of a plunger 200 at the well top. Plunger 200 is shown to represent the plunger of the present invention and will be described below in more detail. Sensing the plunger is used as a programming input to achieve the desired well production, flow times and wellhead operating pressures. A master valve 7 should be sized correctly for a tubing 9 and plunger 200. An incorrectly sized master valve will not allow plunger 200 to pass. Master valve 7 should incorporate a full bore opening equal to tubing 9 size. An oversized valve will allow gas to bypass the plunger causing it to stall in the valve. If the plunger is to be used in a well with relatively high formation pressures, care must be taken to balance tubing 9 size with a casing 8 size. The bottom of a well is typically equipped with a seating nipple/tubing stop 12. A spring standing valve/bottom hole bumper assembly 11 is located near the tubing bottom. The bumper spring is located above the standing valve and can be manufactured as an integral part of the standing valve or as a separate component of the plunger system.

Surface control equipment usually consists of motor valve(s) 14, sensors 6, pressure recorders 16, etc., and an electronic controller 15 which opens and closes the well at the surface. Well flow 'F' proceeds downstream when surface controller 15 opens well head flow valves. Controllers operate on time, or pressure, to open or close the surface valves based on operator-determined requirements for production. Modern electronic controllers incorporate features that are user friendly, easy to program, addressing the shortcomings of mechanical controllers and early electronic controllers. Additional features include: battery life extension through solar panel recharging, computer memory program retention in the event of battery failure and built-in lightning protection. For complex operating conditions, controllers can be purchased that have multiple valve capability to fully automate the production process.

Standard downhole bypass plungers typically have vertical corridors built into them to allow fluids to pass through the plunger during a descent. These corridors are closed when the plunger strikes the bottom of the well and during plunger ascent. When the corridors are open, the plunger falls quickly against flow. Bypass plungers may be used with strong gas wells, flowing wells, and wells that make a lot of fluid. The size of the vertical corridors of a standard bypass plunger cannot typically be varied during the fall or rise of the plunger. Onr type of a standard non bypass plunger operates by pushing its way through fluids, wherein the fluids must flow between the small area between the tubing and the outside of the plunger. Such plungers, without flow through vertical corridors will fall much slower than a plunger with open vertical corridors. When rising near the surface, a plunger with slightly open vertical corridors will slow down signifying that it is losing its seal.

Fall rates of about 1000 to about 2000 feet per minute (fpm) through gas have been experienced. Foss and Gaul reported a 2000 fpm plunger fall rate and incorporated this value into their calculations. Bypass type plungers fall at rates of about 3000 to about 3500 fpm. Abercrombie found that this rate may be too aggressive for general applications, and used a 1000 fpm value in his calculations. If pad, wobble washer or blade plungers are being used, the fall rate can generally be as low as 175 fpm through gas.

Plunger fall rates through liquid range from 17 fpm to 250 fpm. Foss and Gaul used 172 fpm in their calculations.

Plunger rise rates average between about 750 to about 2000 fpm. A common rise rate used is 1000 fpm. In general, the lower the upward velocity, the more efficient the application will be. The drawback to low upward velocity is the possibility of a plunger stalling. If a good seal exists between the plunger and tubing, an operator can attempt to bring the plunger up at speeds less than 1000 fpm. Lower speeds will allow the operator to maintain the well at a lower average casing pressure, and this will maximize reservoir drawdown. The disclosed device can help to slow the plunger's rise, thus optimizing well operation, and minimizing plunger stall.

Since plungers weigh several pounds, they can act as a projectile when traveling at a fall rate of up to about 3500 fpm, or about 30–45 miles per hour (mph). The impact force of a ten-pound projectile, for example, traveling at over 30 mph can clearly impart damage to downhole equipment that it slams against in order to stop while falling downhole. The same problem can exist for rising plungers.

Not only can the disclosed plunger automatically slows down at the bottom (or top) portion of its travel, it can do so without impact. The present invention provides a thermal actuated valve that motivates fluid to flow in or around the plunger as fluid temperature increases or decreases. Thus the plunger's apertures and speeds can be controllable in relation to ambient temperatures.

A wax-filled canister or equivalent can expand internally downhole and move a piston to motivate a valve in a fluid passage corridor in a plunger. When the corridor is closed, the plunger can no longer efficiently pass downhole fluids through it as it falls. Therefore, the temperature of the downhole fluids acts to provide a breaking action on the descending plunger. Production operators can save money with a reduction of broken downhole plunger stops, plungers and the reduction of downtime. An alternate embodiment uses a thermal actuator(s) to expand an outer casing of the plunger, thereby slowing the speed of the plunger.

SUMMARY OF THE INVENTION

An aspect of the present invention is to open/close plunger bypass apertures without impact at a top or a bottom of a well.

Another aspect of the present invention is to provide an automatic brake for a downhole plunger during its falling or rising mode.

Another aspect of the present invention is to use a thermal actuator as the trigger to close a fluid passage corridor in the plunger when the thermal actuator senses an increase in ambient temperature, and to open as the actuator senses a temperature drop.

Another aspect of the present invention is to use a thermal actuator to expand the outer casing of a plunger, thereby slowing its rate of travel. While the expandable plunger is falling, liquid and gas are passing around the O.D. of the plunger. As the plunger nears the bottom of the well where the temperature is increased, the plunger's thermal actuator(s) motivates a valve causing an expansion of the sealing surface of the plunger, making the gap between the tubing and the plunger smaller and allowing for less liquid and gas to pass. Thus plunger fall rate slows.

The present invention uses the known technology of expanding waxes in a closed container to move a piston upon the expansion of the wax (or equivalent) fluid in the container. Once the plunger nears the bottom of the well the actuator will sense a pre-determined actuator temperature and motivate the piston to fully expand the plunger sealing surface, making full contact with the tubing or casing, creating a tight friction seal, thereby forcing the plunger and liquid load to the surface. In one example, the actuator is preset at about 160° F. but any temperature desired may be the set point. Once the plunger has arrived into the lubricator, where cool gas flows around the plunger the thermal actuator(s) will sense a cooling thereby contracting the sealing surface, thus allowing the plunger to fall back to the bottom of the well starting the cycle over.

Other aspects of this invention will appear from the following description and appended claims, reference being made to the accompanying drawings forming a part of this specification wherein like reference characters designate corresponding parts in the several views.

In one embodiment of the present invention, the thermal actuator is filled with an expandable material such as Thermoloid® (Therm-Omega-Tech, Inc.), which changes phase from a solid to a liquid and expands as the temperature increases. Other expandable phase change materials may be used. Since the expandable material can be incompressible and encased in a rigid housing, only the piston can move. When the expandable material cools, the volume contracts and allows the piston to retract if a return force is acting on the piston. The piston will not normally retract unless a return force is present.

The phase change and resultant motion occurs over a narrow temperature range. Such a property can allow precise control of a device at a specific temperature with no significant effect outside a chosen control range.

A temperature actuated valve is encased in a downhole plunger. Temperature change alone can be used to operate the device; e.g., open or close the valve. Push-out pads can be used to open and close valve feet. Because the expandable material can operate in the solid and liquid or gas phase, each of which are typically incompressible, load changes on the piston (within design limits) can have little or no effect on operating temperature. Vapor-filled or liquid to vapor phase change devices can be used, but may be more sensitive to load changes (changing the load on these devices, e.g., changing spring tension, is used to change the operating temperature range).

Since the operating temperature of solid-liquid phase change actuators is determined by various properties of the expandable material (e.g., melting and solidification temperatures), the operating temperature can be extremely stable, repeatable and accurate.

Commercially available thermal actuators are useful in the present invention. Reliable choices are those that can be used in pressure or vacuum, liquid or gas, and can be made from most machineable materials. Custom mounting configurations may be desired. For maximum stroke, a typical temperature change can range from about 10° F. to about 20° F. while start to stroke temperatures can range from about −30° F. to about 300° F. A wide choice of temperature ranges are available. In one embodiment the temperature ranges from about −40° F. to about 325° F.

BRIEF DESCRIPTION OF THE FIGURES

FIGS. 11, 11A, 11B, 11C are sectional views of the FIG. 10 embodiment, the valve in an open mode and the actuator is in a relaxed mode.

FIG. 11D is a top plan view of a plunger in the tubing.

Before explaining the disclosed embodiment of the present invention in detail, it is to be understood that the invention is not limited in its application to the details of the particular arrangement shown, since the invention is capable of other embodiments.

Also, the terminology used herein is for the purpose of description and not of limitation.

DETAILED DESCRIPTION OF THE DRAWINGS

When the plunger falls to the bottom of a well a thermal actuated valve will close by sensing heat. It will open at the top of a well when it senses cool temperature gas flowing around the plunger.

Figure 1:
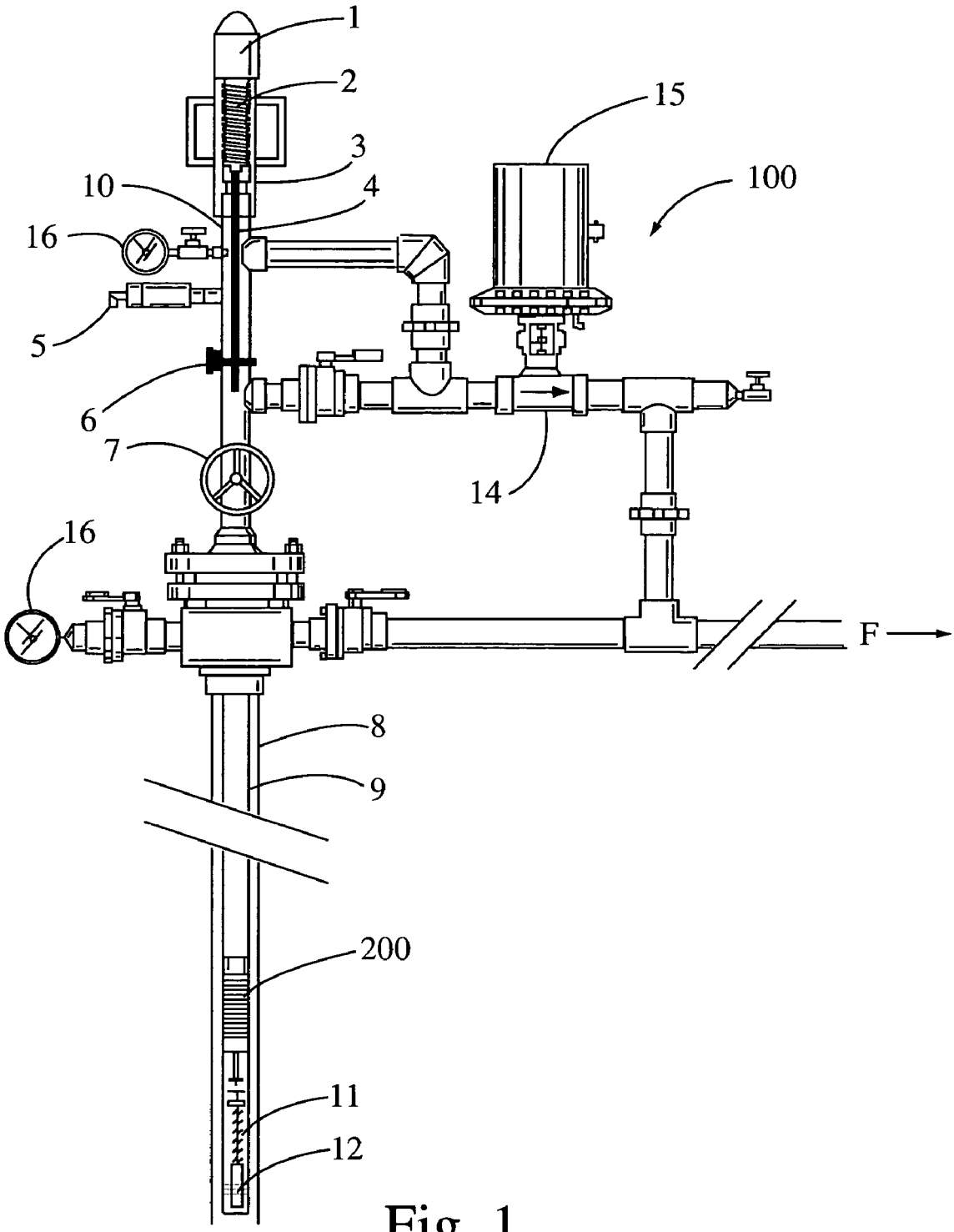
Fig. 1 (PRIOR ART)
FIG. 1 (prior art) is a schematic drawing of a typical plunger lift well.
Figure 2:
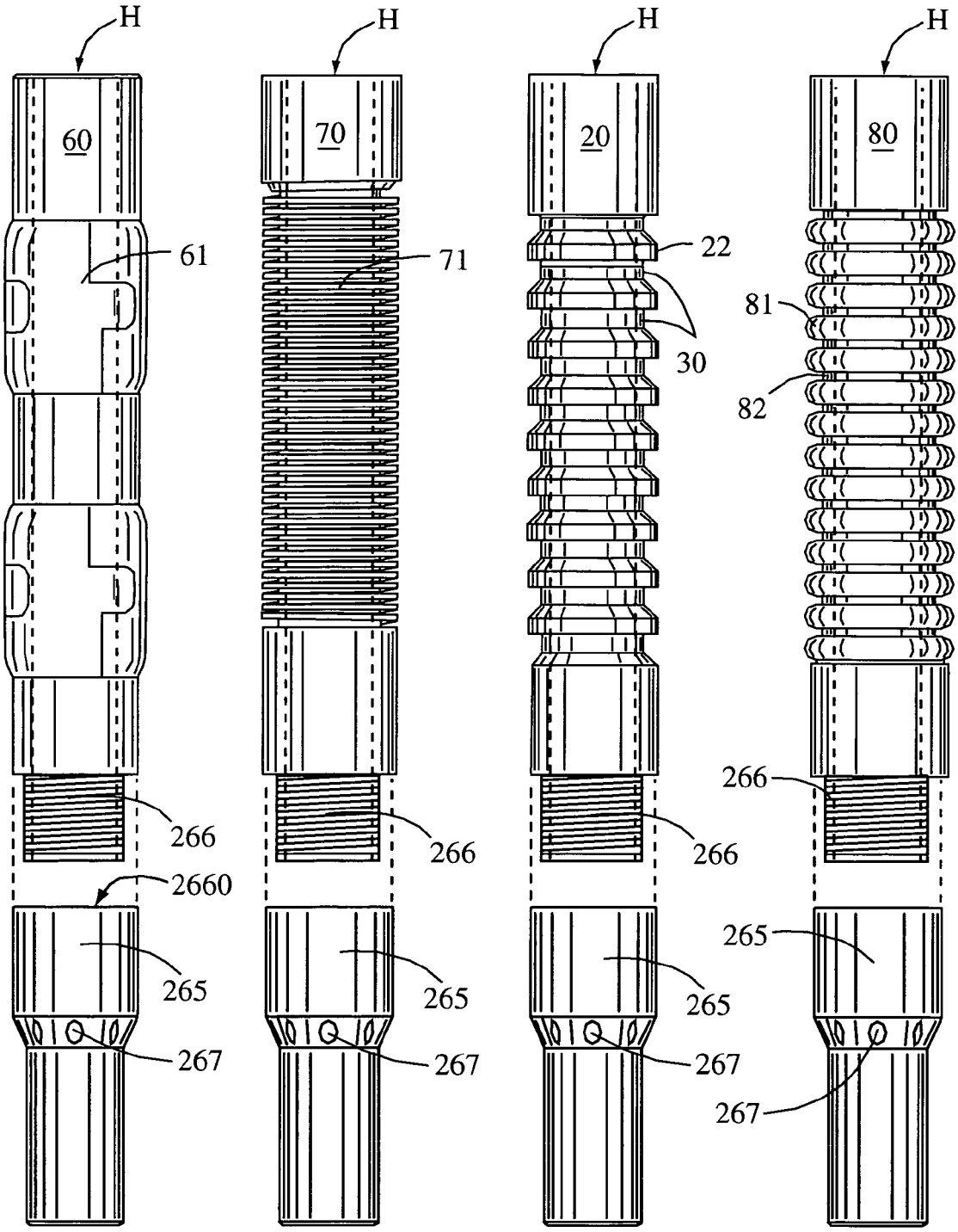
Fig. 2 (PRIOR ART)
FIG. 2 is a side elevational view of four typical prior art plungers each having a male connector.

FIG. 2 shows side views of various plunger mandrel embodiments. The plunger mandrel embodiments described below have an internal orifice H to allow fluid flow.

Plunger mandrel 20 is shown with solid ring 22 sidewall geometry. Solid sidewall rings 22 can be made of various materials such as steel, poly materials, Teflon®, stainless steel, etc. Plunger mandrel 80 is shown with shifting ring 81 sidewall geometry. Shifting rings 81 allows for continuous contact against the tubing to produce an effective seal with wiping action to ensure that all scale, salt or paraffin is removed from the tubing wall. Shifting rings 81 are individually separated at each upper surface and lower surface by air gap 82. Plunger mandrel 60 has spring-loaded interlocking pads 61 in one or more sections. Interlocking pads 61 expand and contract to compensate for any irregularities in the tubing thus creating a tight friction seal. Plunger mandrel 70 incorporates a spiral-wound, flexible nylon brush 71 surface to create a seal and allow the plunger to travel despite the presence of sand, coal fines, tubing irregularities, etc.

The plungers each have a threaded connector 266. A thermal actuated canister 265 screws onto a threaded connector 266 via threaded collar 2660. Under normal conditions during the free fall of the plunger, holes 267 are open, and fluid flows into holes 267 and through internal orifice H. Under high temperature conditions as the plunger reaches (thousands of feet) downhole, holes 267 are automatically and proportionally shut according to temperature. When the holes 267 are fully shut, then the fluids can only flow between the plunger and the casing 9 (this is the case for a non-flowing well in a shut-in state). In this manner, the plunger's rate of fall is reduced.

Figure 3:
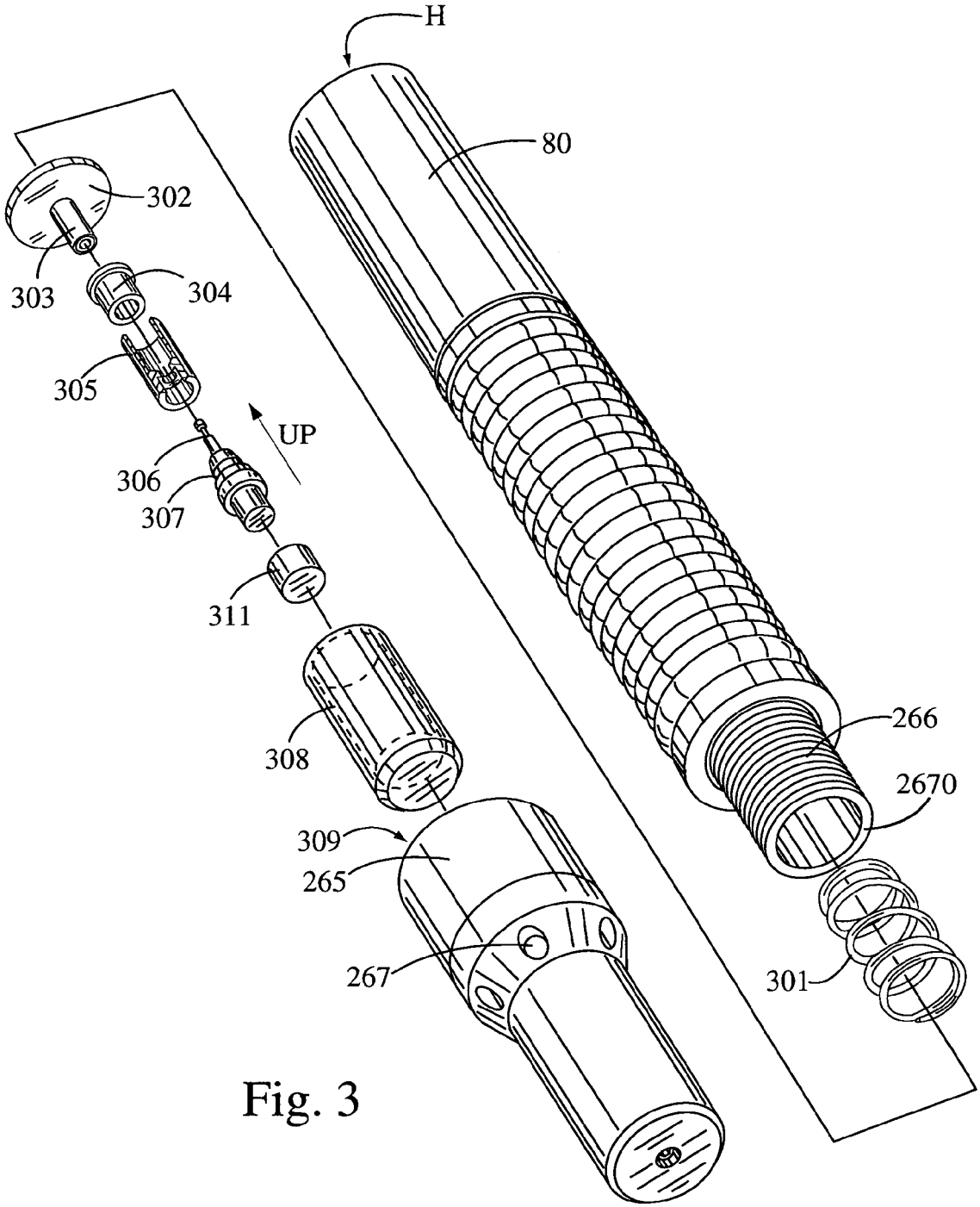
FIG. 3 is an exploded view of one embodiment of a thermal actuated plunger.
Figure 4A:
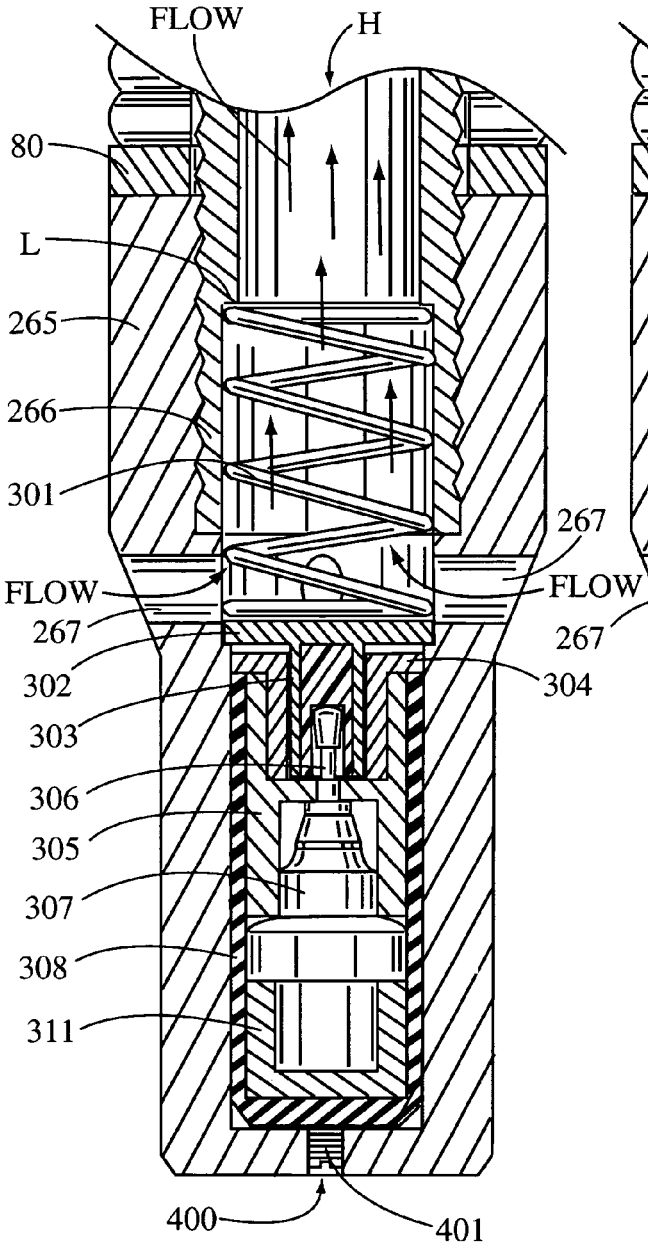
FIG. 4A is a sectional view showing the valve of FIG. 3 motivating the piston to close.
Figure 4B:
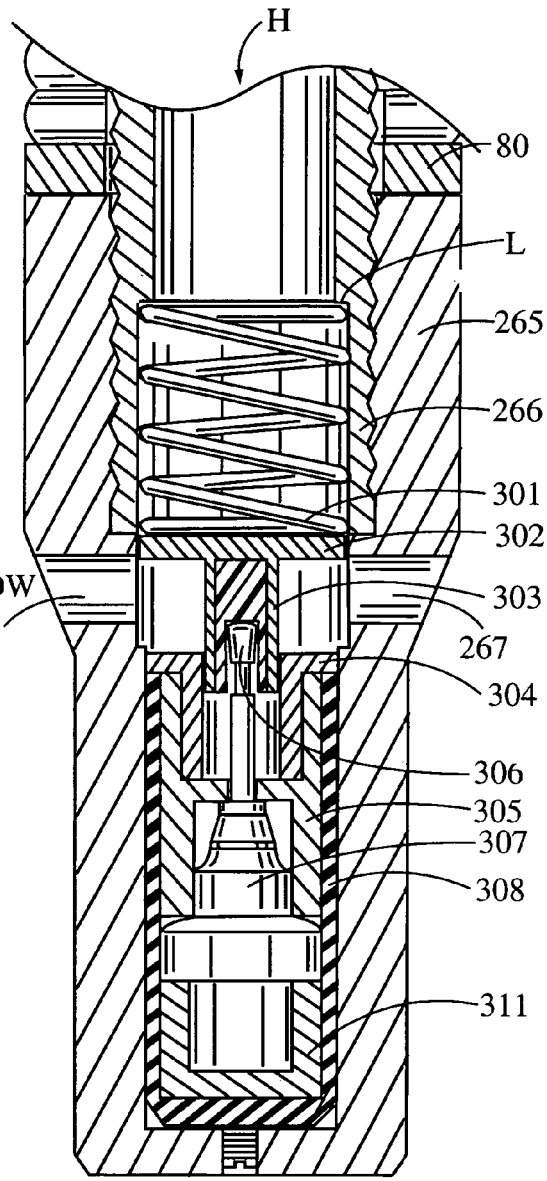
FIG. 4B is a sectional view showing the thermal actuator of FIG. 3.

Referring next to FIG. 3, plunger 80 has threaded connector 266 which has an internal ledge L (see FIGS. 4A, 4B). Ledge L supports a spring 301 to push against a valve seat 302. An insulator 304 supports a stem 303 inside a heat conductive mass 305 (e.g. brass) which seats against a stationary thermal actuator 307. When the heat conductive mass 305 and thermal actuator 307 are heated, a piston 306 extends in direction UP, thereby pushing the valve seat 302 up over holes 267.

A sheath 308 (preferably a rubber insulation) houses the elements 303, 304, 305, 306, 307 inside cavity 309 of the canister 265. A metal cup 311 holds thermal actuator 307 and serves as a thermal mass.

Sheath 308 can be sized to keep the downhole heat away from thermal actuator 307 until the plunger nears bottom. At the bottom, ambient heat heats sheath 308 which heats thermal actuator 307, closing the bypass valve for the plunger's journey up the tubing. Near the top, ambient gas cools thermal actuator 307, so it proportionally opens allowing gas to escape up through the plunger, losing the gas seal, thus slowing the plunger down. Sheath 308 keeps the heat away from the actuator on the way to the bottom of the well so the valve stays open. Then sheath 308 holds the heat in to keep the actuator closed until it reaches the top of the well. Insulation may or may not be used depending on the application and type of plunger. The size of sheath 308 can be tailored to slow the heat transfer in the plunger before it reaches bottom, and partially open at top to slow the travel time.

Referring next to FIGS. 4A, 4B a hole 400 receives a set screw 401 to adjust the seating tension of the valve seat 302 against the spring 301. FIG. 4A shows the device at a cold ambient temperature, so thermal actuator 307 has not pushed piston 306 up. The downhole fluid passes through holes 267 shown by arrows FLOW and through orifice H. In this position of valve seat 302, plunger 80 can fall at its maximum velocity.

In FIG. 4B, ambient temperatures have expanded the interior of thermal actuator 307, thereby moving piston 306 UP, valve seat 302 has been raised to block the flow of fluid from holes 267 and seat on the tube 2670 (FIG. 3) up orifice H. When the temperature cools, spring 301 will move valve seat 302 back down to its rest position shown in FIG. 4A.

Figure 5:
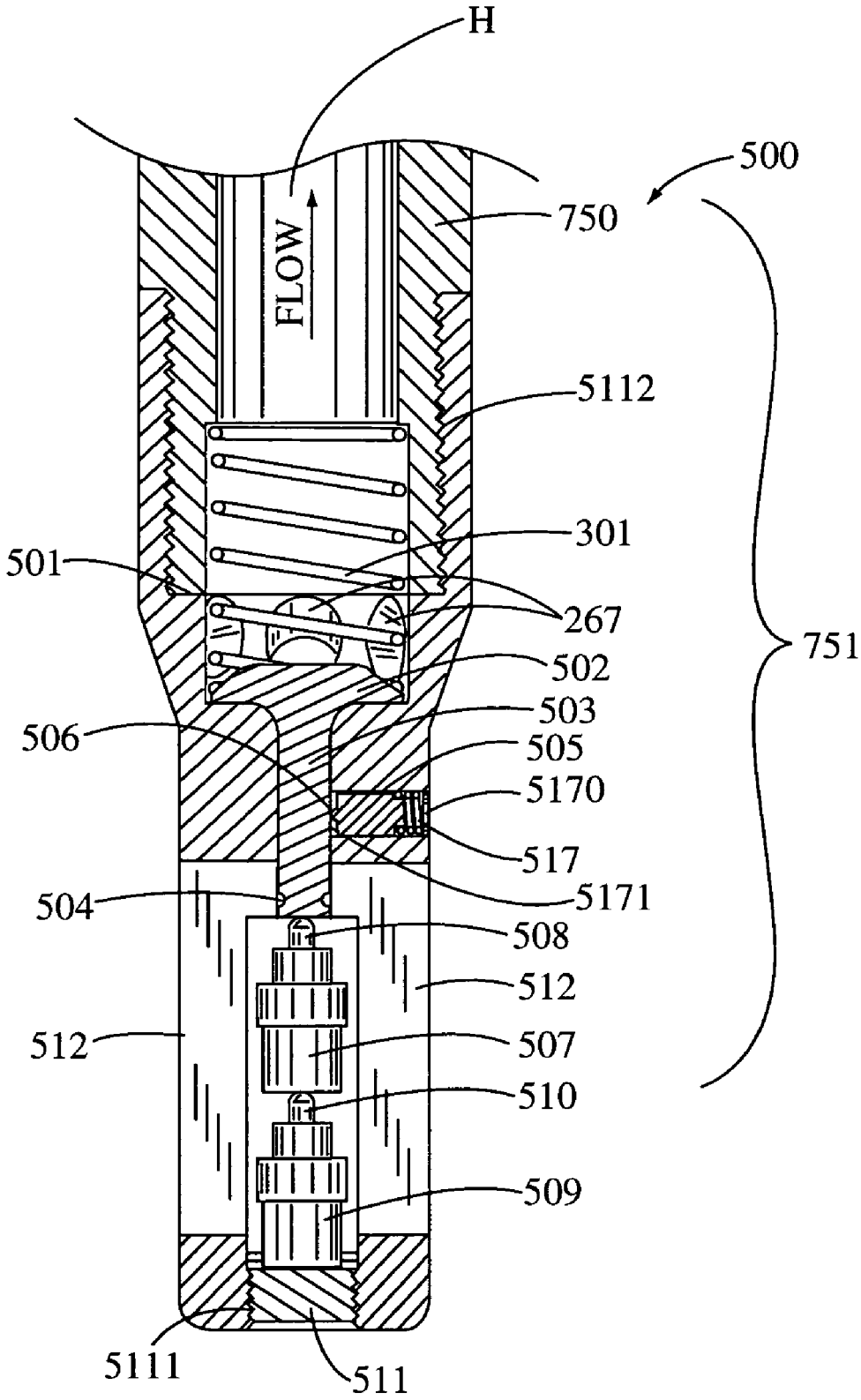
FIG. 5 is a sectional view of at least two actuators, the valve in an open position.

Referring next to FIG. 5, a plunger 500 has orifice H through which fluid flows via holes 267 as shown by the arrows FLOW. A bypass valve assembly 751 screws onto a body 750 via threads 5112. A valve seat 501 receives a valve 502, which is shown in the open mode. Spring 301 urges valve 502 closed. A valve stem 503 has a groove 504 which receives a piston 506 when closed. A thermal actuator 505 can be nominally set to expand (e.g. at about 10° above surface ambient) so that it opens/closes near the surface of the well. A spring 517 holds thermal actuator 505 against groove 504. A snapring 5170 secures the spring in a cavity 5171.

Slots 512 allow fluid to flow directly against thermal actuators 507, 509 without any insulation. The thermal actuators are selected for different actuation temperatures or setpoints, for example 140° F., 150° F., etc. A plug 511 with threads 5111 allows "in-the-filed" replacement of different actuation temperature actuators to get the best results. In this example pistons 508, 510 move about ¼ inch each, resulting in a total displacement of the valve stem 503 of about half an inch. Other distances are possible if desired. With differing actuation temperatures, valve 502 can first be half closed for part of its travel, and then fully closed at the bottom of the well; on the rise just the opposite would occur. Once closed, actuator 505 locks the stem by inserting piston 506 in groove 504. FIG. 5 shows the thermal actuated plunger embodiment in an open bypass mode.

Figure 6:
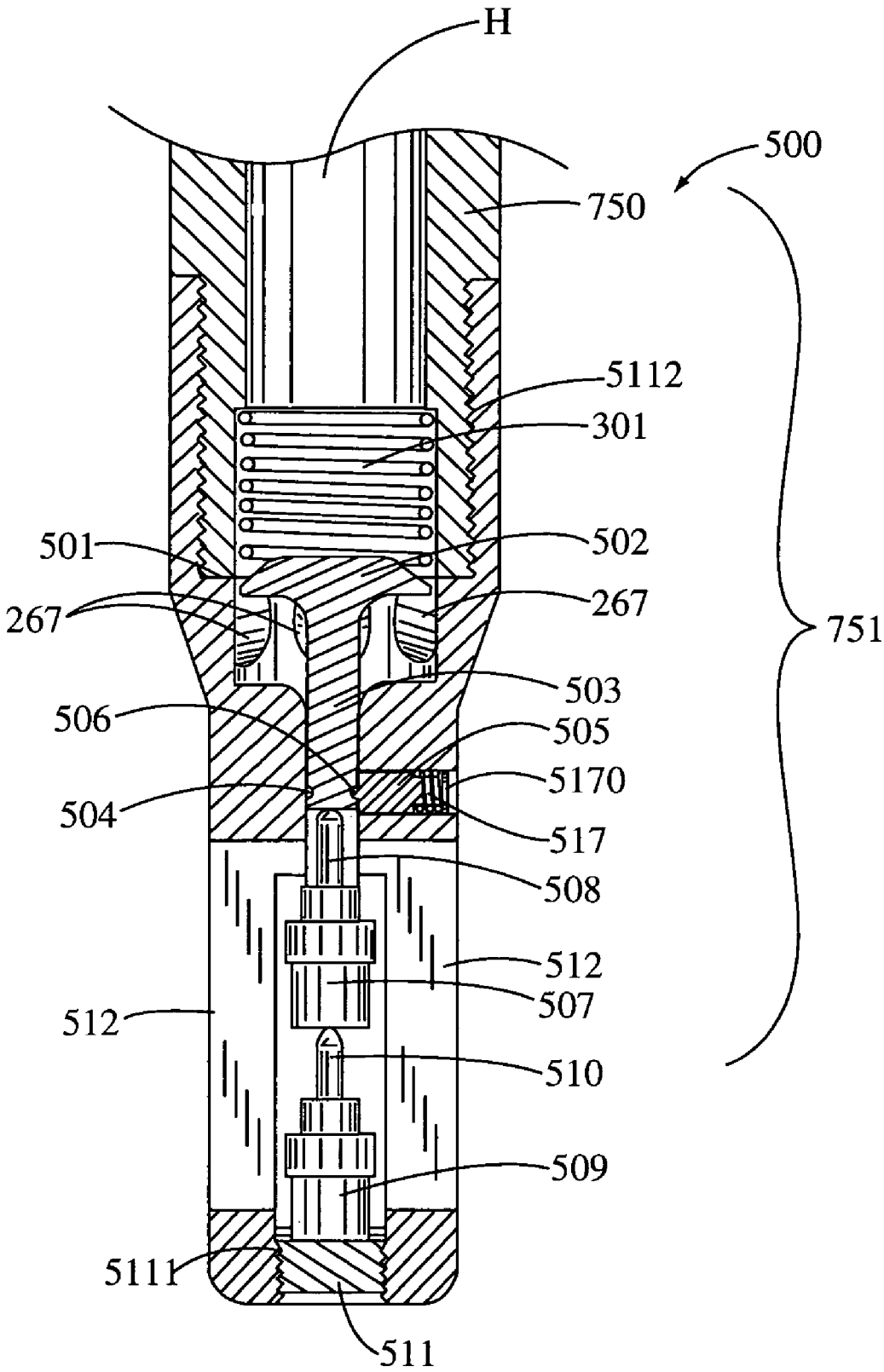
FIG. 6 is the same view as FIG. 5 with the valve in an closed position.

Referring next to FIG. 6, both actuators 507, 509 have reached their actuating temperatures and closed valve 502. Plunger 500 is ready to rise to the surface and keep a tight seal between the gas below it and the water/oils above it. Near the surface, in order to slow down, the actuators start to open to let gas pass into orifice H, thereby slowing plunger 500 down. FIG. 6 shows the thermal actuated plunger embodiment in a closed bypass mode.

For flowing wells, the two (or more) setpoint thermal actuator systems are typically used to make sure that no full closure of the valve occurs until the plunger reaches bottom. If a valve closes before the plunger reaches bottom of a flowing well, the plunger can change direction, going up propelled by gas flow without any liquid above the plunger. The disclosed method uses multiple setpoints to partially close valve 502, and to not totally close the valve on the way down.

Figure 7:
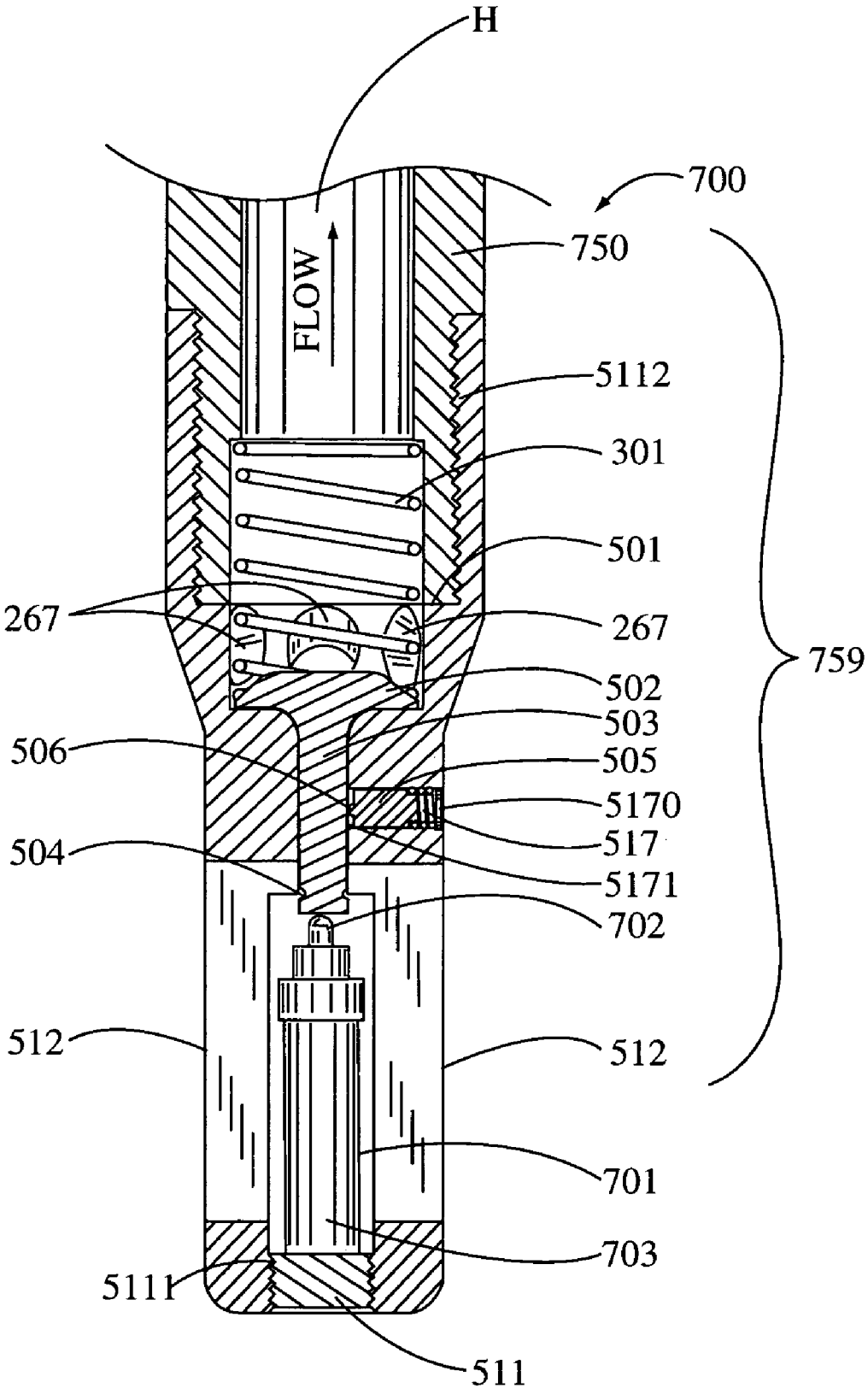
FIG. 7 is a sectional view of a dual expansion fluid thermal actuator, the valve in an open position.
Figure 8:
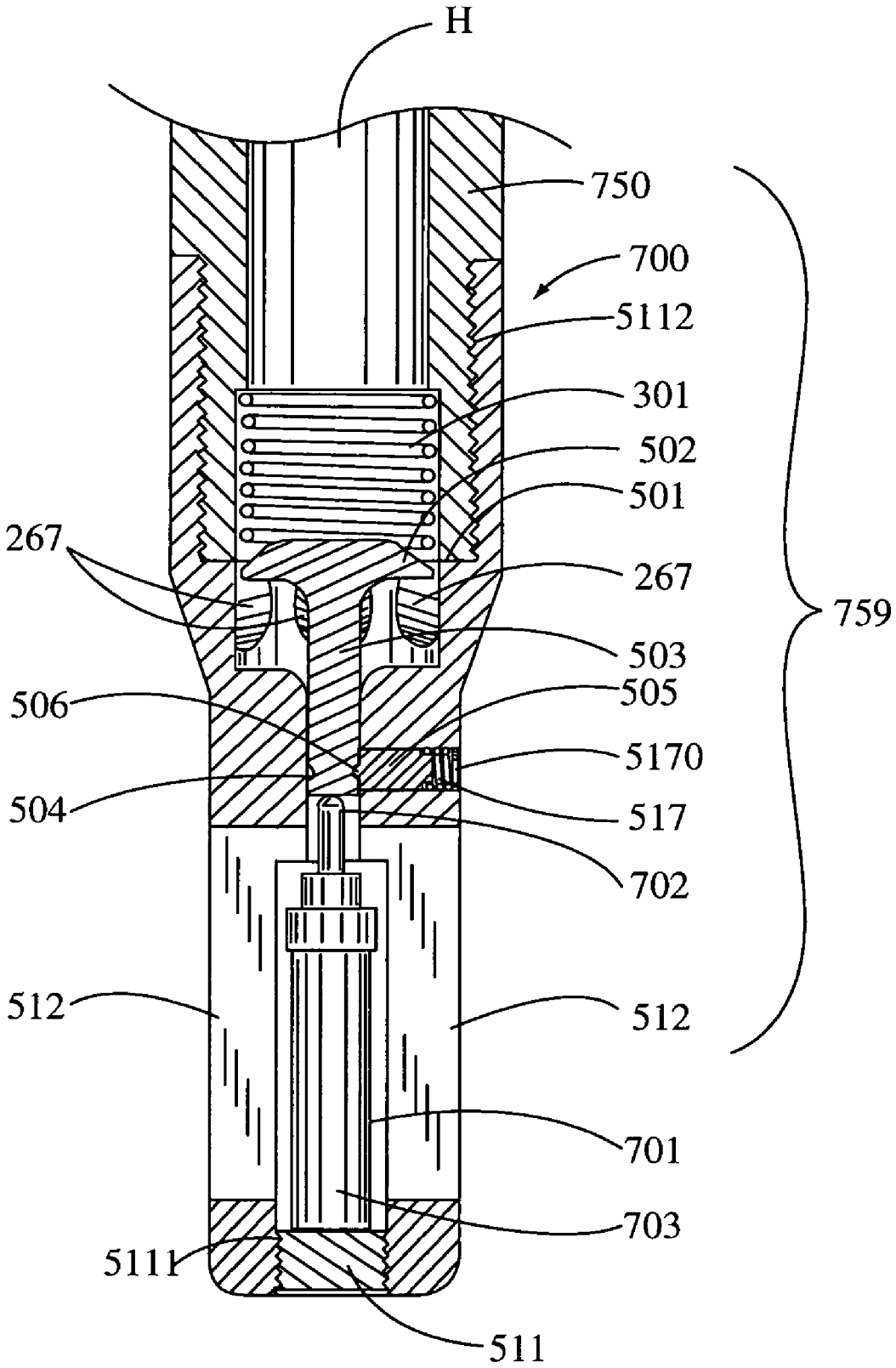
FIG. 8 is the same view as FIG. 7, the valve in an closed position.

Referring next to FIG. 7, a plunger 700 functions the same as plunger 500 of FIGS. 5, 6. FIG. 7 shows the plunger embodiment in an open mode; FIG. 8 shows the plunger embodiment in a closed mode. Valve 502 is shown open in a bypass valve assembly 759 which screws onto a body 750 via threads 5112. A thermal actuator 701 has a piston 702 that can travel nominally about a half inch. Expansion material 703, known in the art, can be selected as a mixture to have multiple temperature actuating setpoints such as the sample setpoints described in actuator plunger 500 of FIGS. 5, 6. Once a well is precisely calibrated for its temperature gradients downhole, then thermal actuator 701 can be properly made, perhaps saving money compared to a two (or more than two) actuator embodiment.

Referring next to FIG. 8, valve 502 is shown closed. Piston 506 has engaged groove 504. Near the cool surface piston 506 will withdraw so that spring 301 can force valve 502 back down to the open position.

Figure 9:
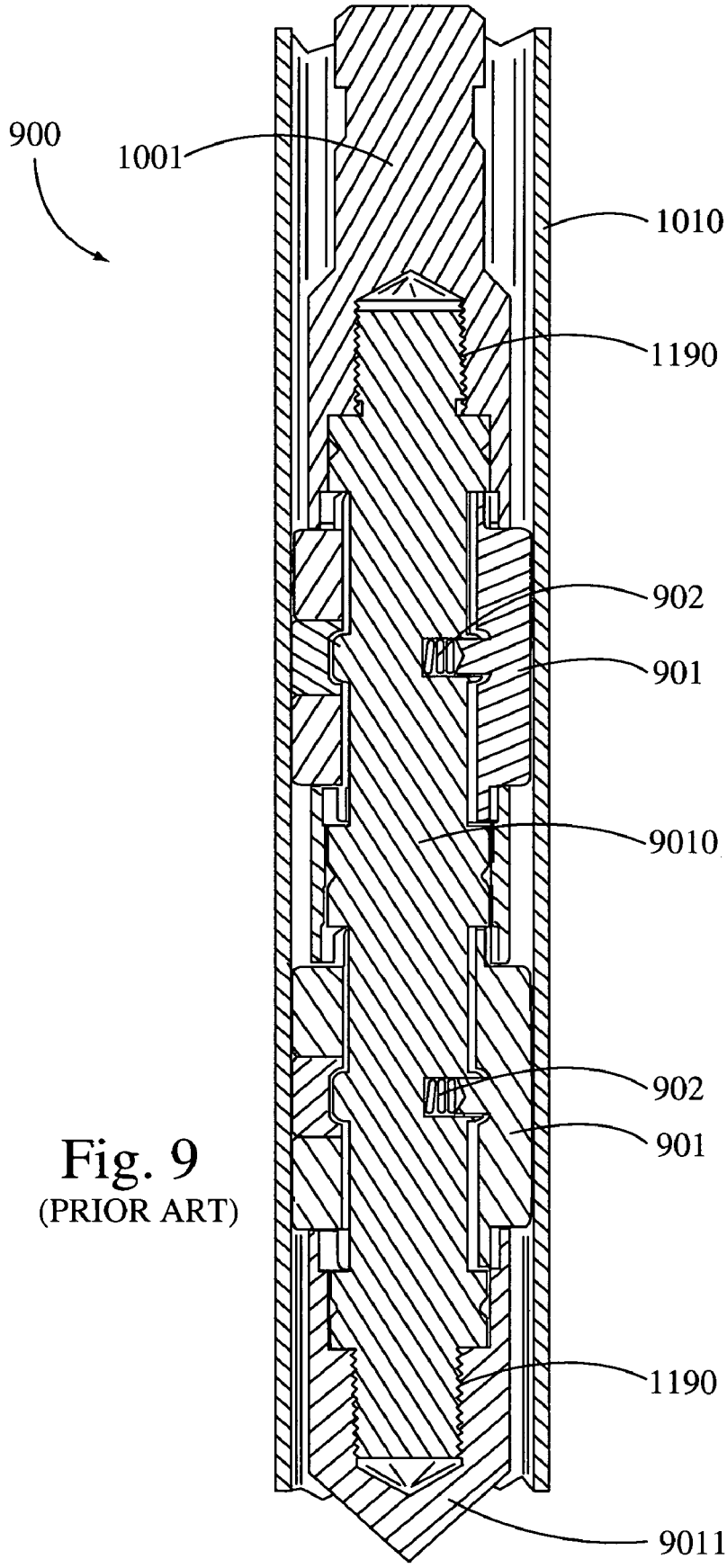
Fig. 9 (PRIOR ART)
FIG. 9 (prior art) is a sectional view of an expanding pad plunger.
Figure 10:
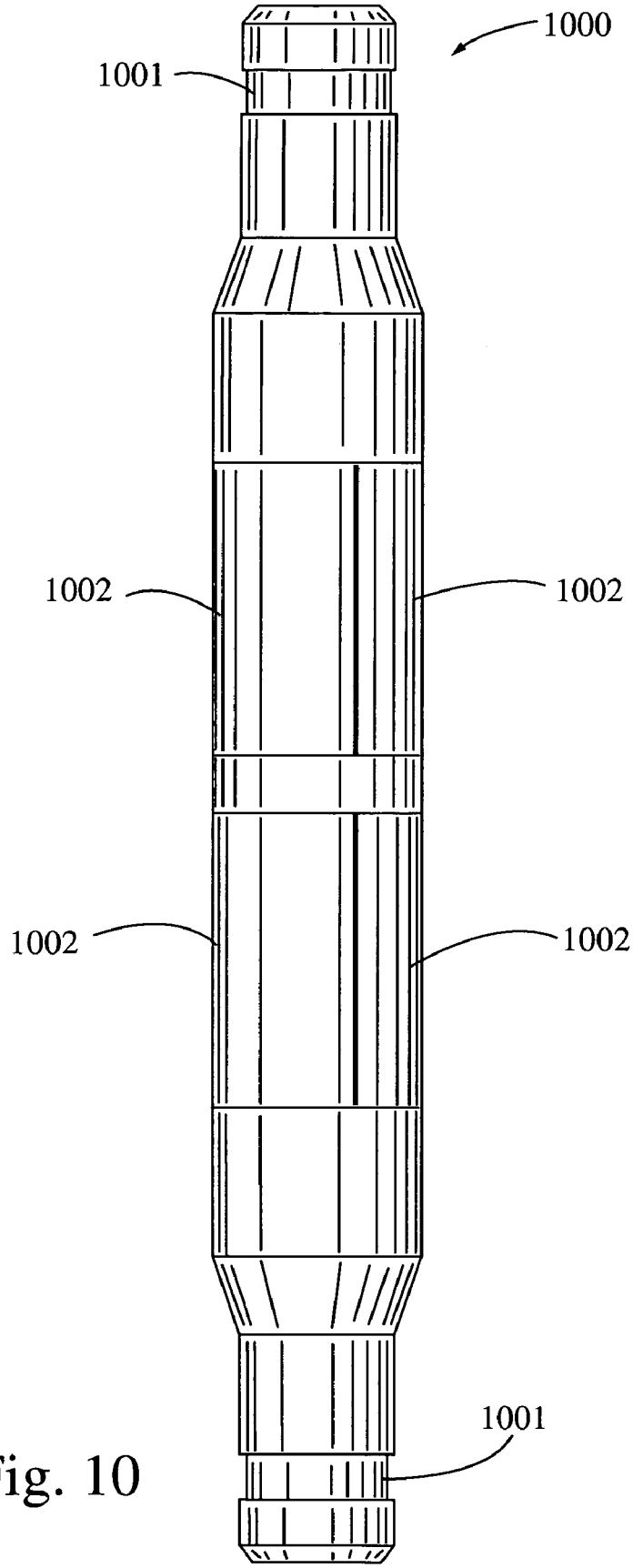
FIG. 10 is a side elevation view of a thermal actuated expanding pad plunger.

FIG. 9 (prior art) shows a tubing 1010 having a pad plunger 900 with pads 901 extended by springs 902. This plunger generally has no adjustments. Its major drawback is a slow fall rate due to the tight seal between pads 901 and tubing 1010. However, it is a very efficient plunger going up the tubing because of its tight seal. It lifts liquids above the rising gas with little leakage. Threads 1190 connect a fishneck body 1001 to the central mandrel 9010 of plunger 900. Mandrel 9010 connects to fishneck body 1001 via threads 1190 and a nose 9011.

Figure 12:
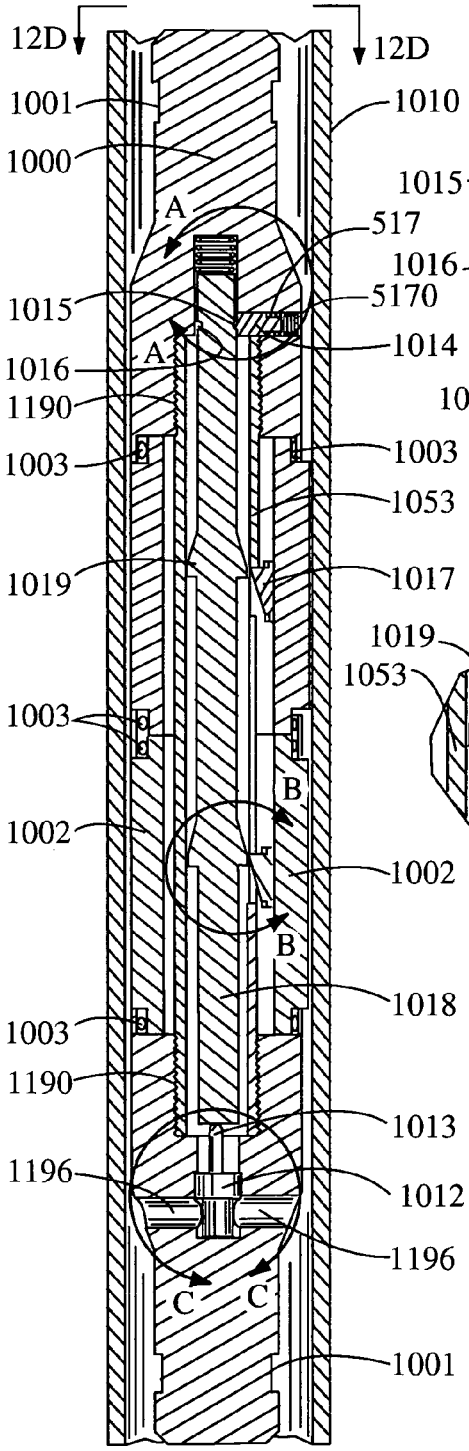
FIGS. 12, 12A, 12B, 12C are sectional views of the FIG. 10 embodiment, the valve in a closed mode and the actuator is motivating the piston.
Figure 12A:
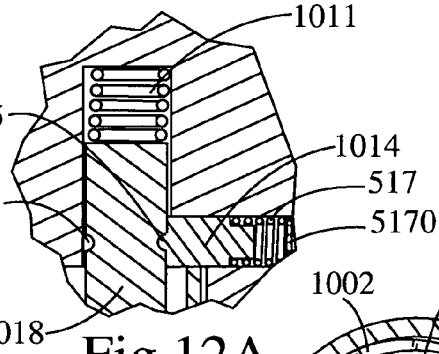
Figure 12D:
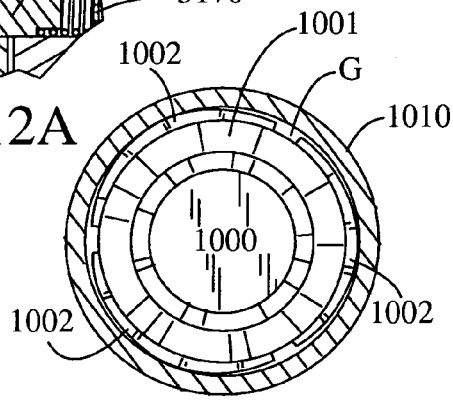
FIG. 12D is the same view as FIG. 11D with the pads expanded.
Figure 12B:
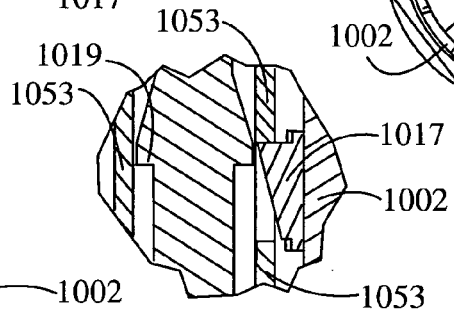
Figure 12C:
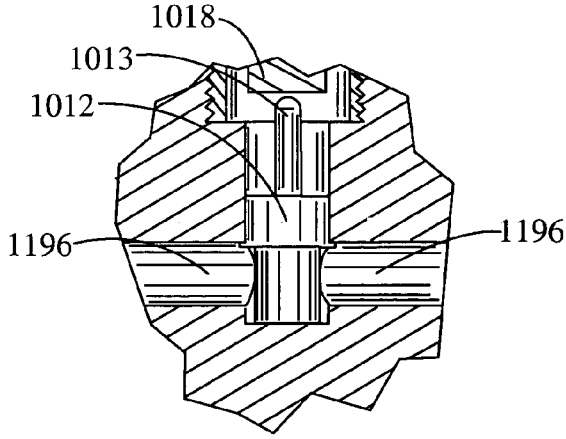

Referring next to FIGS. 10, 11, 11A, 11B, 11C, 11D, a moving pad plunger 1000 is shown to have fishing neck ends 1001 whose bodies screw onto a mandrel 1195 via threads 1190. Therefore, either end can be inserted into tubing 1010. FIGS. 11-11D depict the plunger embodiment in an open passive mode. FIGS. 12-12D depict the plunger embodiment in a closed activated mode. Metal pads 1002 (or rubber cup equivalent) are held in the closed mode by springs 1003 (which could be rubber O rings). This creates a gap G for fluids to pass around the outside of the plunger. Mandrel 1195 supports pads 1002. Fluid channels 1196 allow the downhole heat to reach a thermal actuator 1012.

A central shaft 1018 has cam extensions 1019. Thermal actuator 1012 has a piston 1013 which, upon reaching setpoint temperature, pushes a shaft 1018 upward, thereby causing cam extensions 1019 to push outbound the wedges 1017 which in turn push outbound pads 1002. Sleeves 1053 hold wedges 1019 in place. A spring 1011 returns shaft 1018 to the passive mode shown in FIG. 11. In this embodiment, a second thermal actuator 1014 has a piston 1015 which locks into groove 1016 in the activated mode shown in FIGS. 12–12D.

Figure 13:
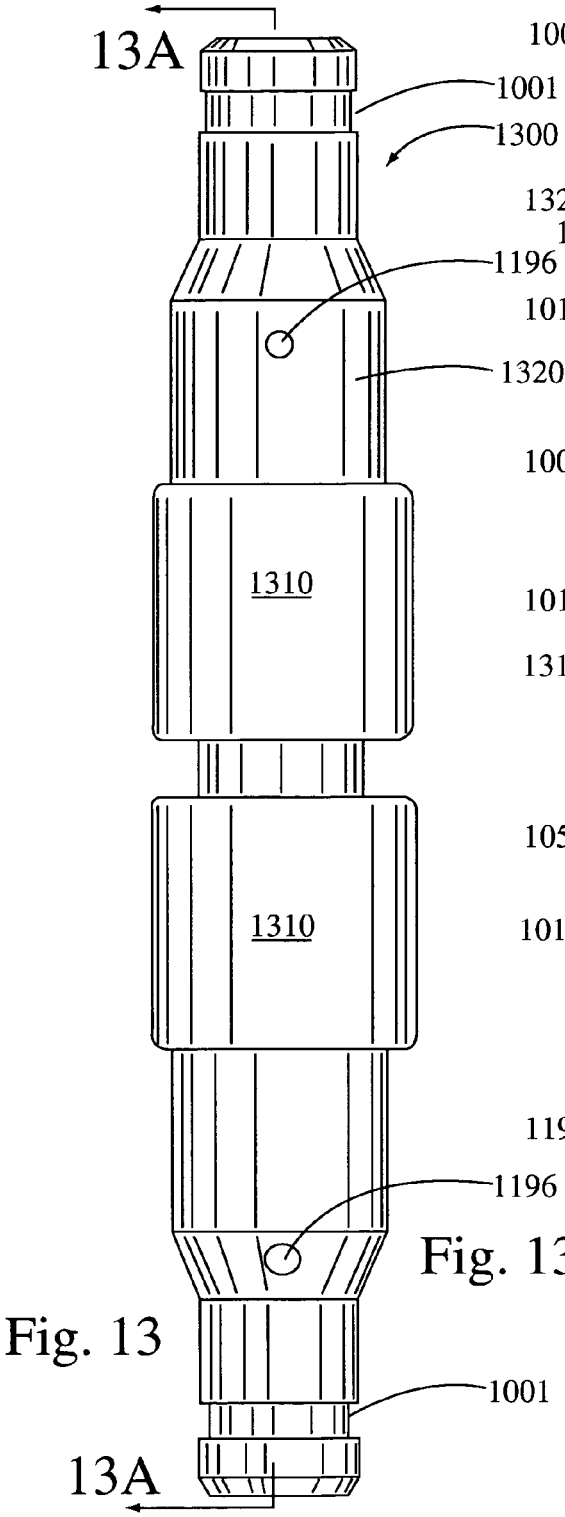
FIG. 13 is a side elevational view of a rubber pad type plunger where the pads are expanded.
Figure 13A:
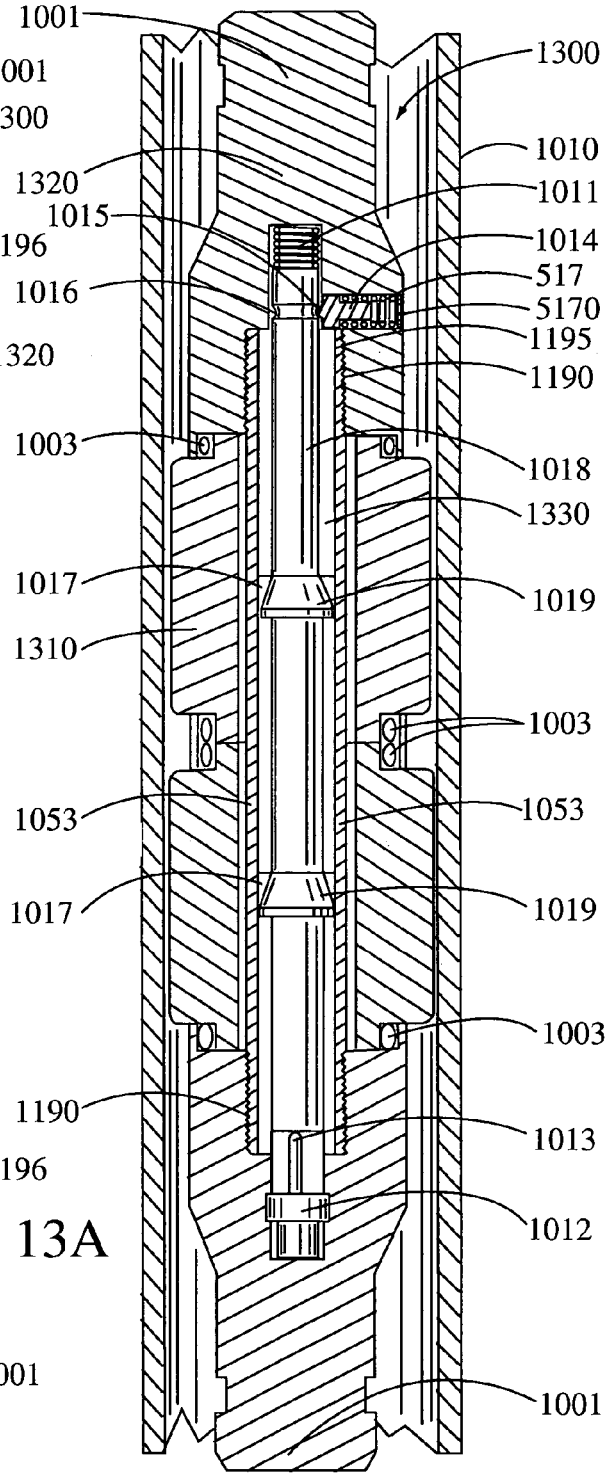
FIG. 13A is a longitudinal sectional view taken along line 13A—13A of FIG. 13.

Referring next to FIGS. 13, 13A, a rubber pad plunger embodiment 1300 has a fishing neck 1001 at each end. A body 1320 has an internal hollow 1330 which houses central shaft 1018 which has cam extensions 1019. Thermal actuator 1012 moves shaft 1018 in the same manner as the embodiment of FIGS. 10, 11, 12. Sleeves 1053 hold wedges 1017 in place, wherein rubber cylindrically shaped pads 1310 are expanded out to create a tight seal perhaps for a slim hole or casing plunger application. The gap G is virtually eliminated in the activated mode shown.

Figure 14:
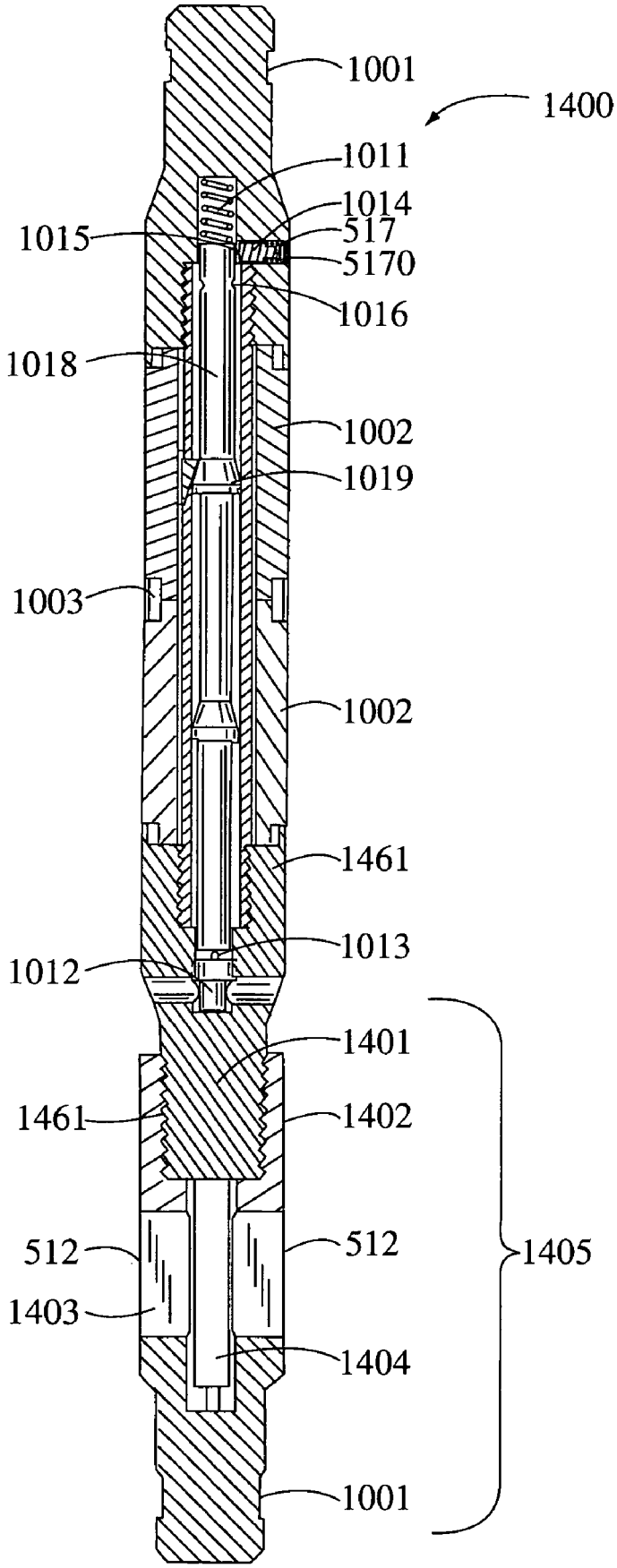
FIG. 14 is a sectional view of a data logger/thermal actuated plunger.

Referring next to FIG. 14, embodiment 1400 comprises a thermal actuated plunger/data logger combination having top and bottom fishing necks. A bottom end 1401 is threaded via threads 1461 to screw into a top 1402 of a canister 1405. Canister 1405 contains a hollow 1403 with slots 512 to allow ambient liquids to contact a data logger 1404. The data logger can be a prior art device containing an electronic recorder and a thermocouple, see co-pending U.S. Application Ser. No. 11/060,513 claiming the benefits of provisional application No. 60/545,679, filed Feb. 18, 2004, incorporated herein by reference. When canister 1405 is unscrewed from bottom end 1401 of plunger 1400, data logger 1404 can be removed to retrieve its data. The term environmental sampler, as used herein, includes a data logger, a fluid-sampler, any micro processor, and/or a corrosion test sample.

Figure 15:
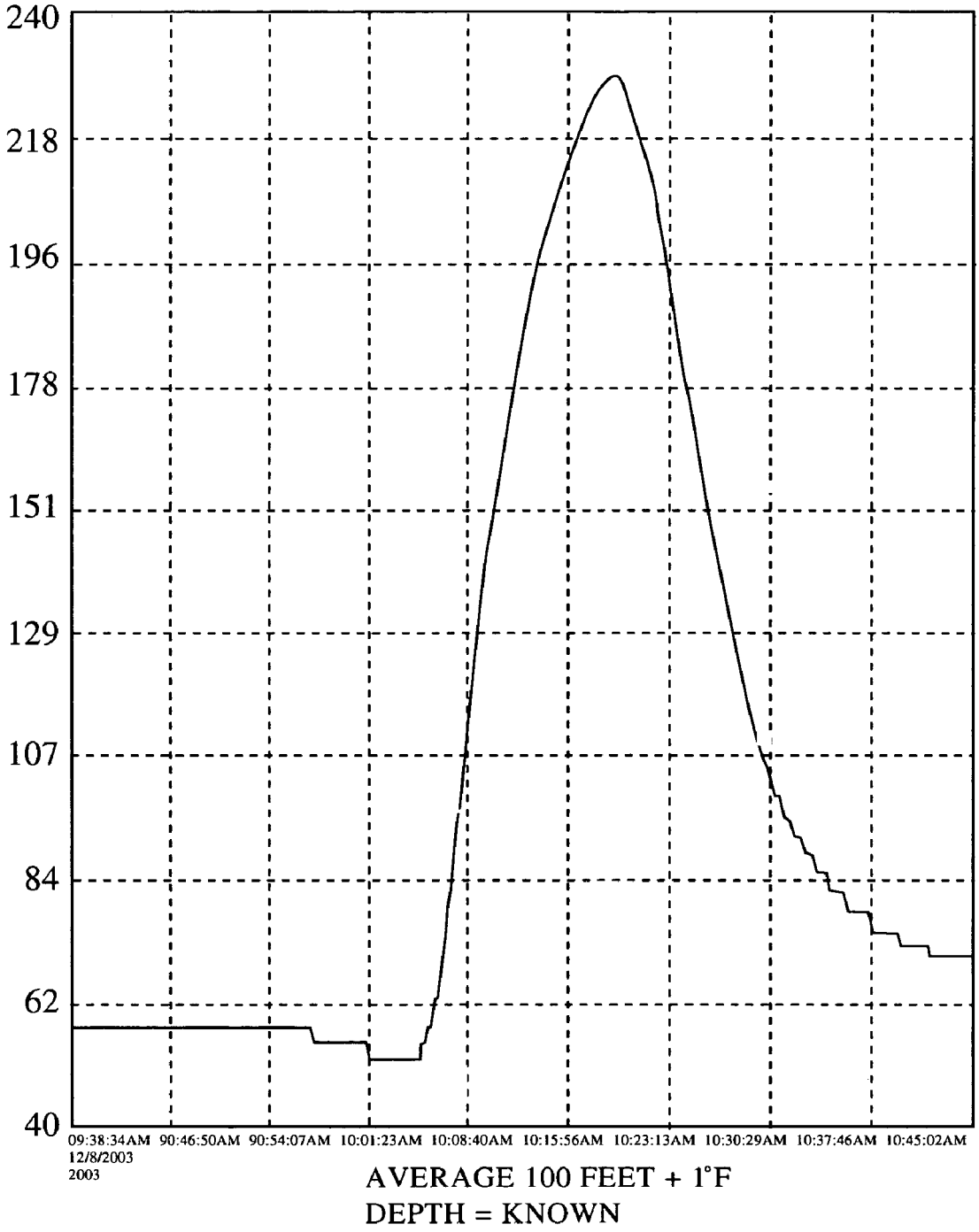
FIG. 15 is a temperature vs. time profile of a well.

Referring next to FIG. 15, a plot of data from data logger 1404 (FIG. 14) is shown. As shown, an average of about 1° F. is gained with each one hundred feet of depth. However data may vary. For example, due to a thermal lag the actual time of arrival at the bottom of the well might be about 10:14 a.m. or so rather than at the peak temperature reached at about 10:18 a.m. or so.

Figure 16:
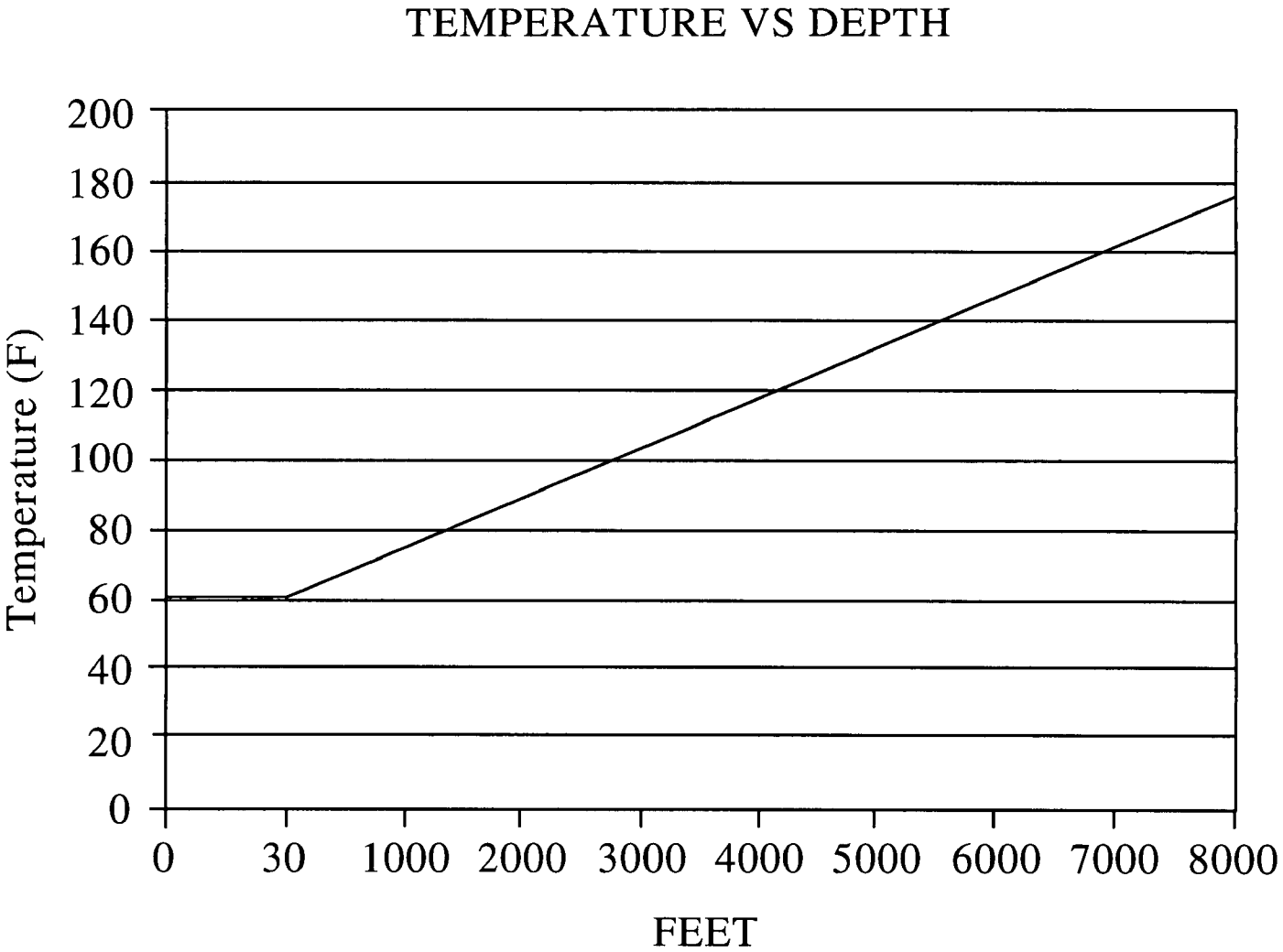
FIG. 16 is a chart of well depth vs. temperature.

Referring next to FIG. 16, the depth of the well may be known as well as the cycle time of the data logger to descend and return from the bottom of the well. Therefore, the temperature vs. depth can be calculated as shown. Based on the type of data shown in FIGS. 15, 16, the desired expansion materials for the various thermal actuators can be selected.

Figure 17:
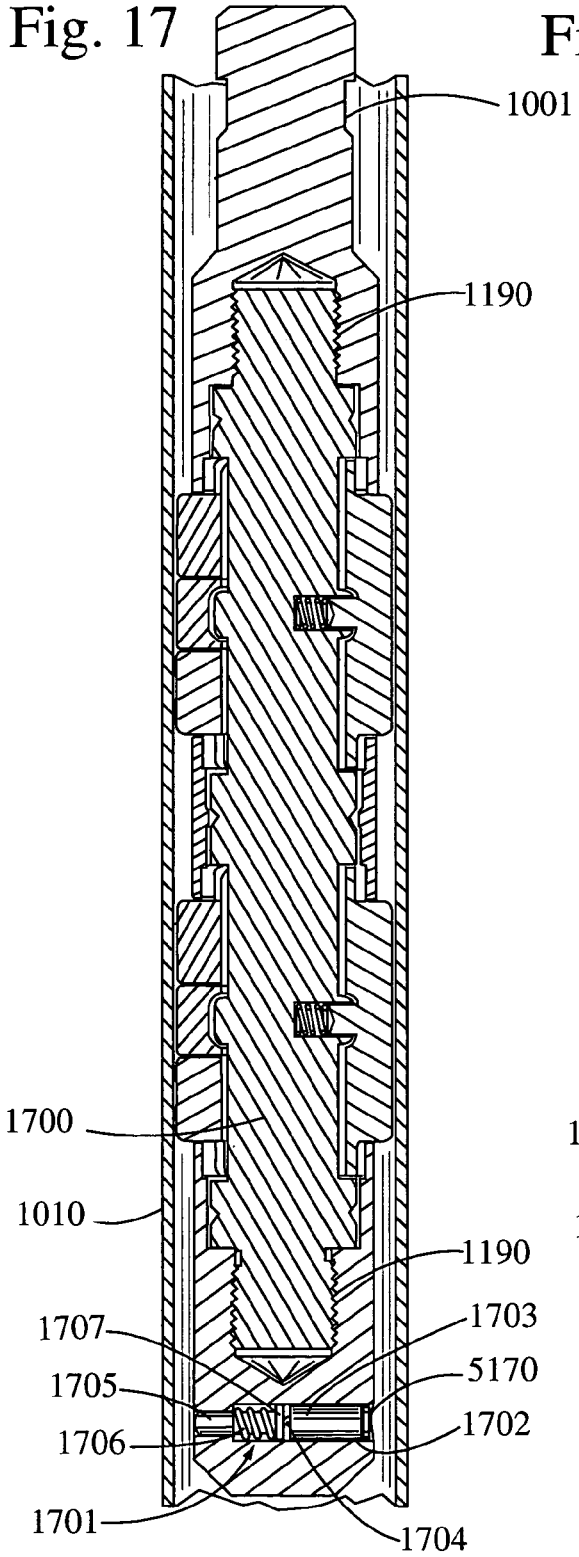
FIG. 17 is a sectional view of a plunger with a thermal actuated brake in a relaxed mode.
Figure 18:
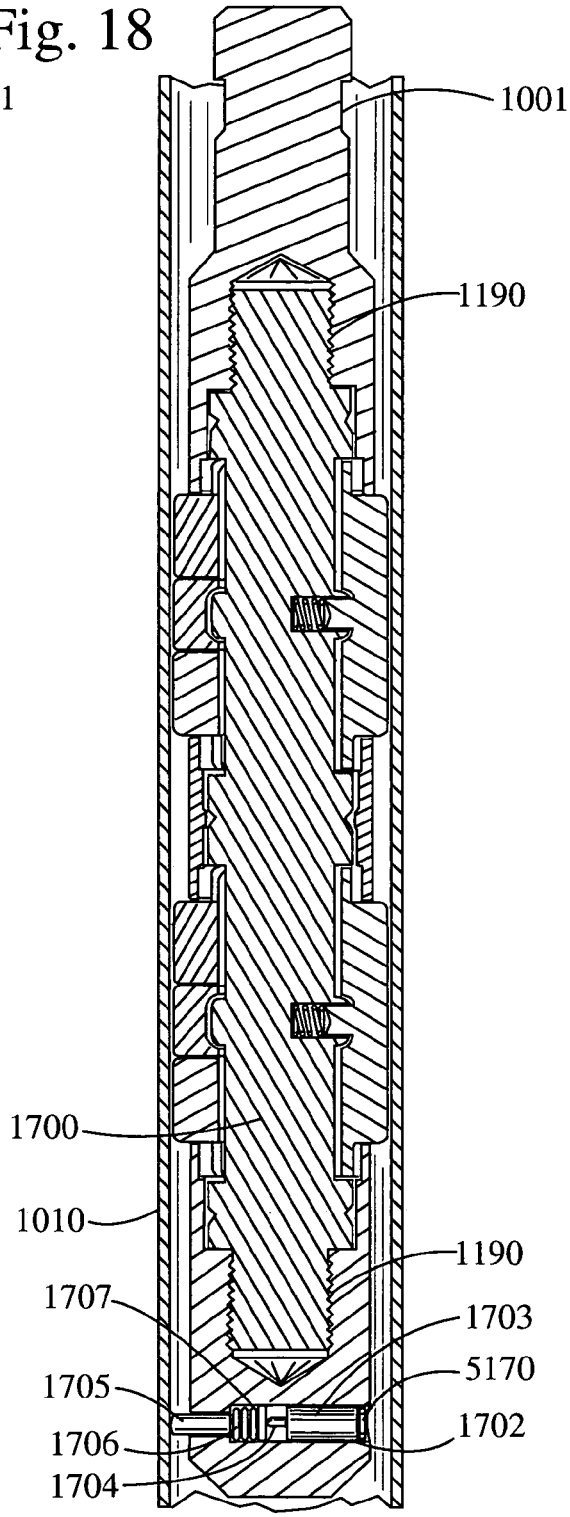
FIG. 18 is the same view as FIG. 17 with the brake motivated.

Referring next to FIGS. 17, 18, a generic plunger 1700 represents any plunger. Anywhere along its length, a thermal activated brake assembly 1701 is installed in a hole 1702. A thermal actuator 1703 is shown motivated in FIG. 18 exposing its piston 1704. Piston 1704 pushes a brake arm 1705 against the inside of tubing 1010 as shown in FIG. 18. When thermal actuator 1703 reaches its cooled, non-expansion, set-point temperature, then a spring 1706 urges a collar 1707 on the brake arm 1705 back to the passive position shown in FIG. 17. Brake arm 1705 slows the travel of plunger 1700.

Figure 19A:
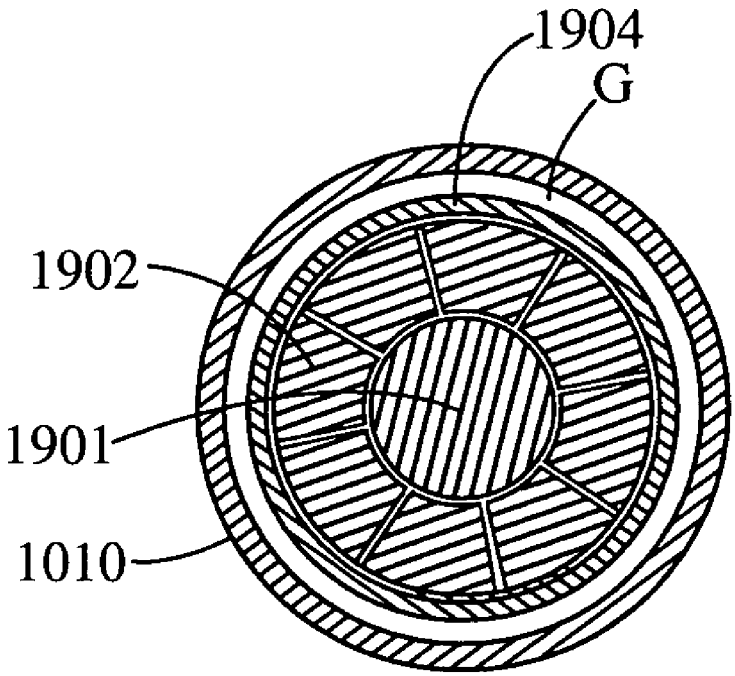
FIG. 19A is a cross sectional view of the rubber pad plunger of FIG. 19.
Figure 20A:
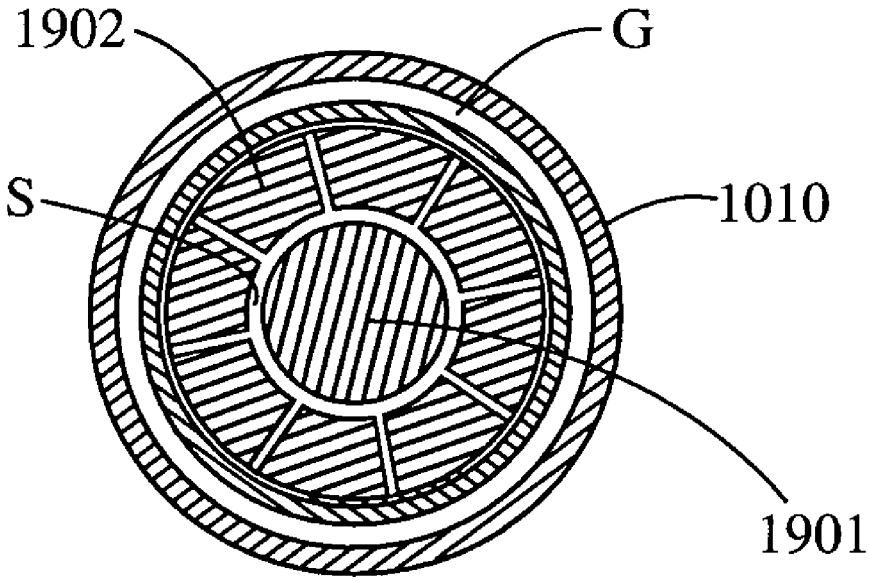
FIG. 20A is the same view as FIG. 19A showing the rubber pad beginning to seal the tube.
Figure 19:
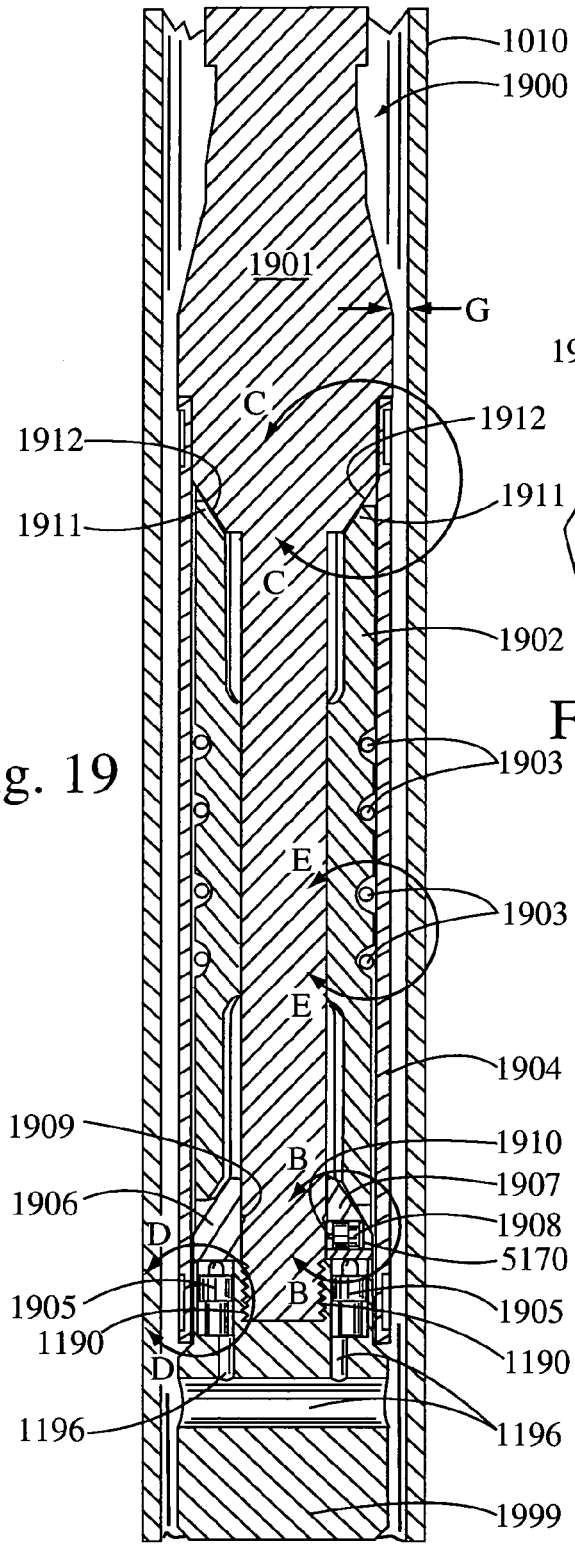
FIG. 19 is a longitudinal sectional view of a rubber pad plunger the actuator(s) in a relaxed mode.
Figure 19C:
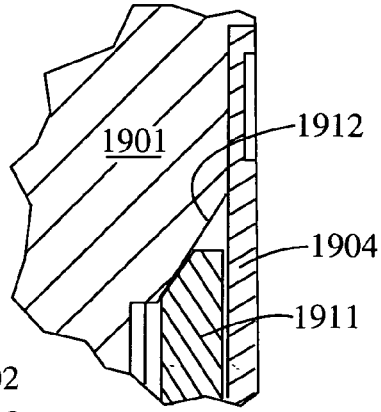
FIG. 19C is a close-up detail of circle C of FIG. 19 showing the upper wedge of the expansion assembly.
Figure 19E:
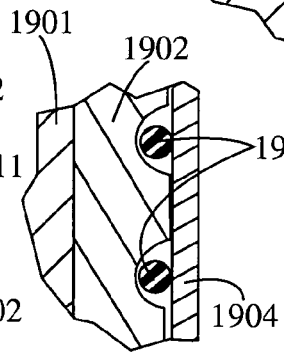
FIG. 19E is a close-up detail of circle E of FIG. 19 showing the metal spring or rubber O ring used to return the rubber pads to the relaxed position as shown in FIG. 19.
Figure 19D:
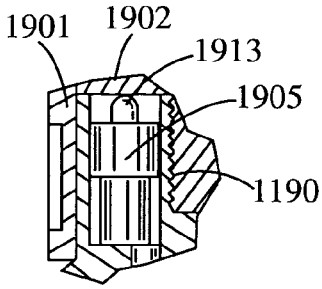
FIG. 19D is a close-up detail of circle D of FIG. 19 showing the expansion assembly thermal actuator.
Figure 19B:
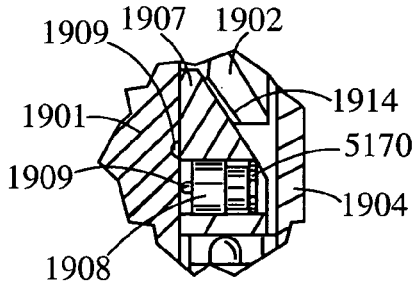
FIG. 19B is a close-up detail of circle B of FIG. 19 showing the locking thermal actuator.
Figure 20:
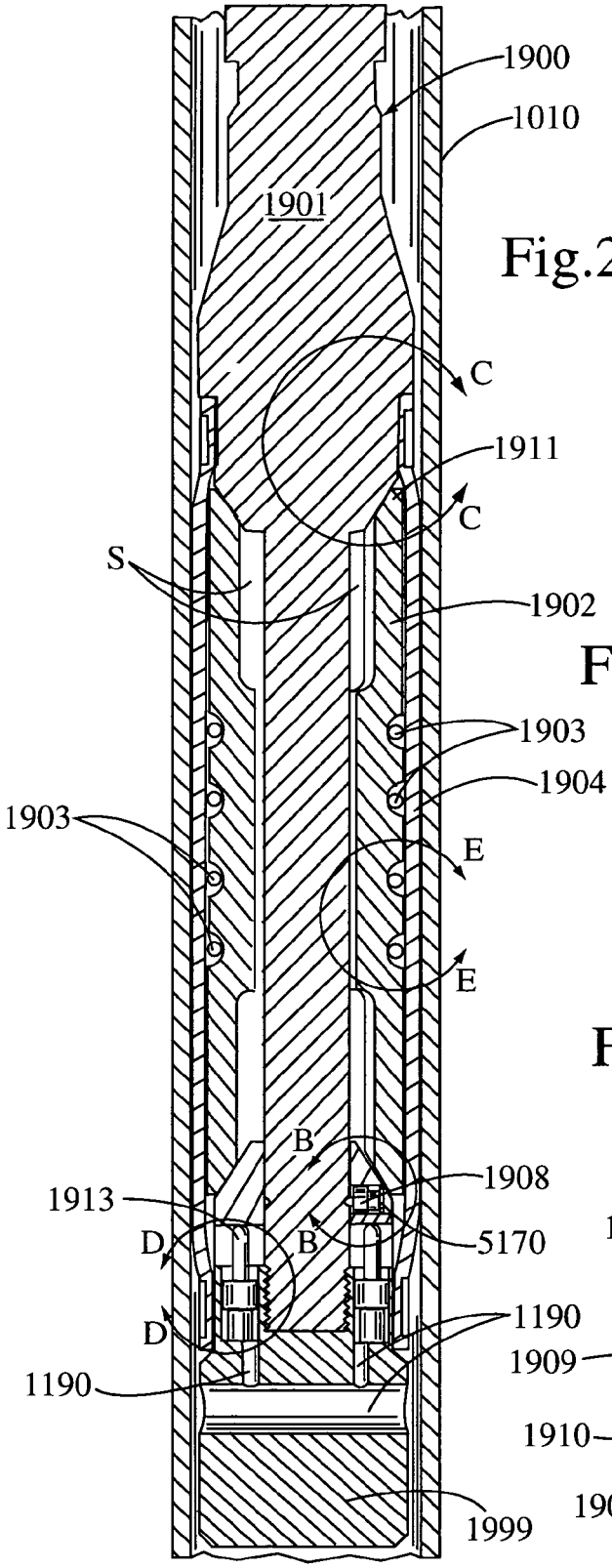
FIG. 20 is the same view as FIG. 19 showing the rubber (cylindrical) pad, the actuator(s) in a motivated position.
Figure 20C:
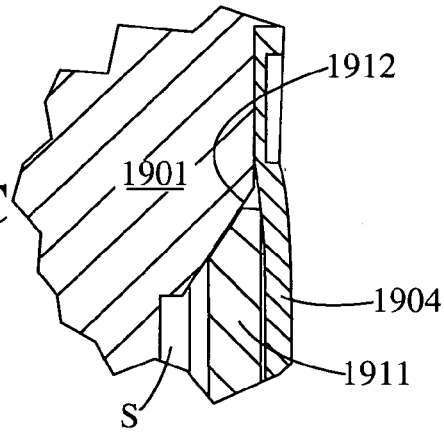
FIG. 20C is the same view as FIG. 19C showing the upper wedge forcing the rubber pad to the open position.
Figure 20E:
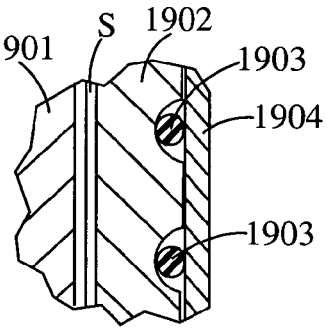
FIG. 20E is the same view as FIG. 19E showing the rubber pad expanded.
Figure 20D:
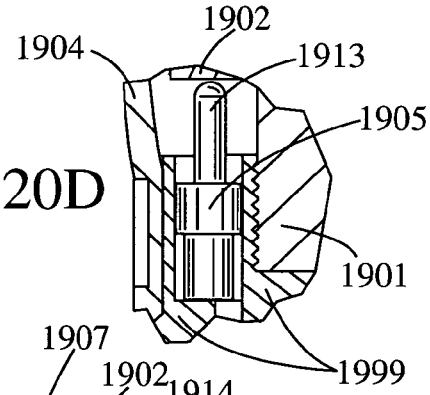
FIG. 20D is the same view as FIG. 19D showing the expansion assembly actuator closing the valve.
Figure 20B:
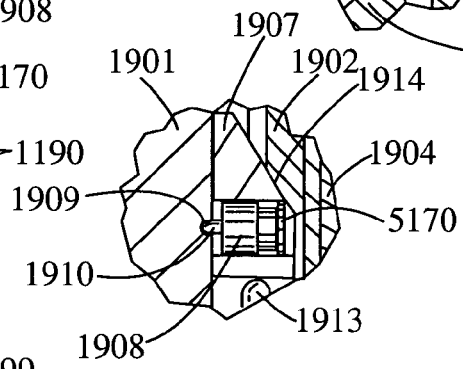
FIG. 20B is the same view as FIG. 19B showing the locking thermal actuator in the locked position.

Referring next to FIGS. 19–19E and 20-20E, a rubber pad plunger 1900 has a cylindrically shaped rubber pad 1904. A cross section is shown in FIG. 19A, wherein the pad is in a contracted position. An expansion assembly comprises a plurality of longitudinal cylindrical segments 1902 which, as shown in FIG. 19 in the passive position, form a cylinder. Segments 1902 are held in the closed position by round springs 1903 which could be rubber O rings. The expansion assembly further comprises a cam ring 1906 with a segment 1907 that houses a locking thermal actuator 1908. Locking thermal actuator 1908 has a locking piston 1910 that latches into a groove 1909 when expansion thermal actuators 1905 push cam ring 1906 up into the open position shown in FIG. 20. As shown in FIG. 20A, pad segments 1902 begin to move outbound to an expanded position. Thermal actuators 1905 rest in holes in a bottom plug 1999 having threads 1190 for connection to the plunger core 1901. Plunger core 1901 is stationary. Upper cams 1911 slide against the core ledge 1912, and (lower) cam ring 1906 slides against segment ledge 1914. Pistons 1913 push cam ring 1906 up against segments 1902, virtually eliminating gap G as rubber pad 1904 is pushed against tubing 1010. Space S should widen.

Figure 21:
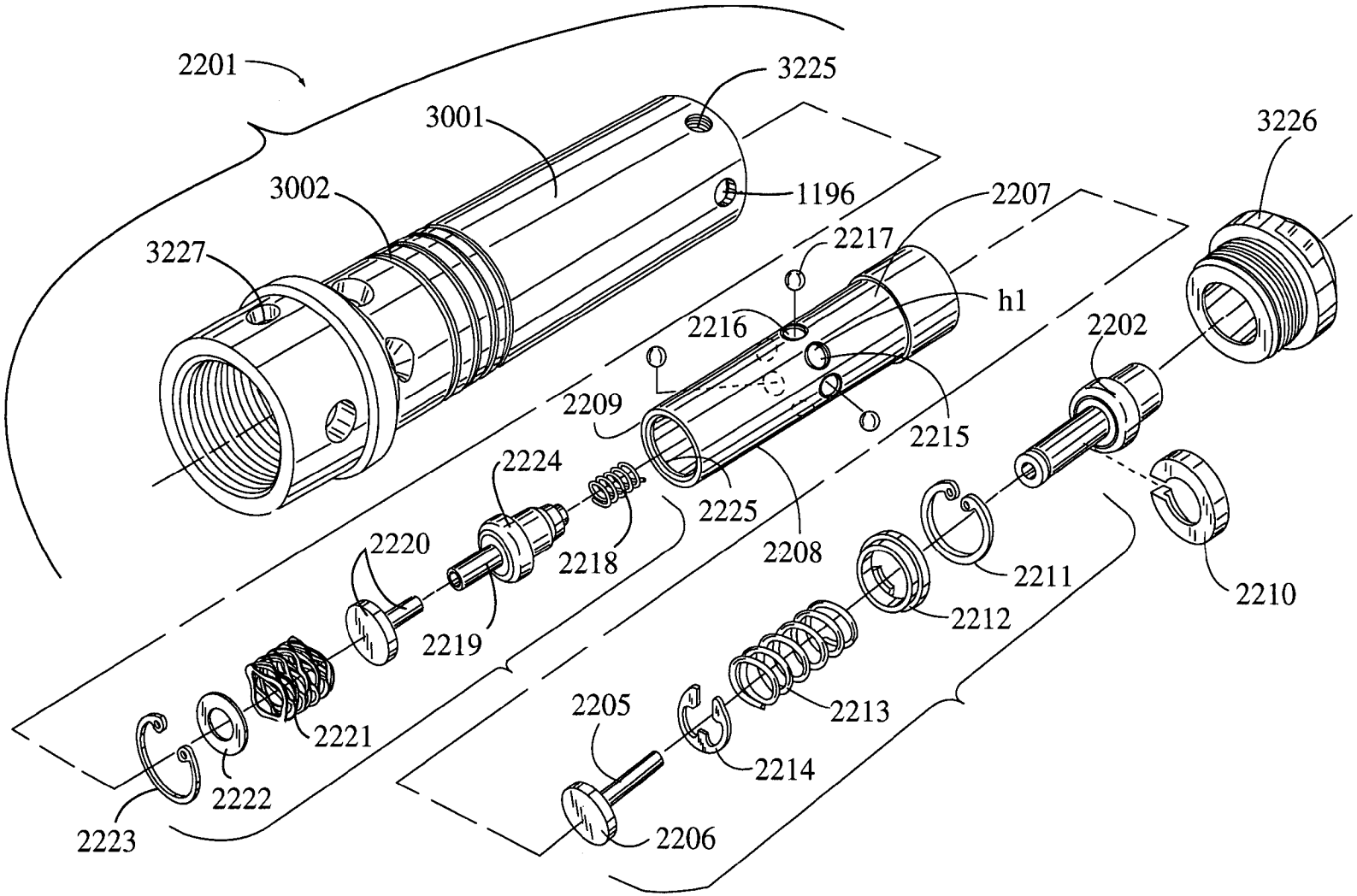
FIG. 21 is an exploded view of a thermal actuated internal bypass plunger.
Figure 22:
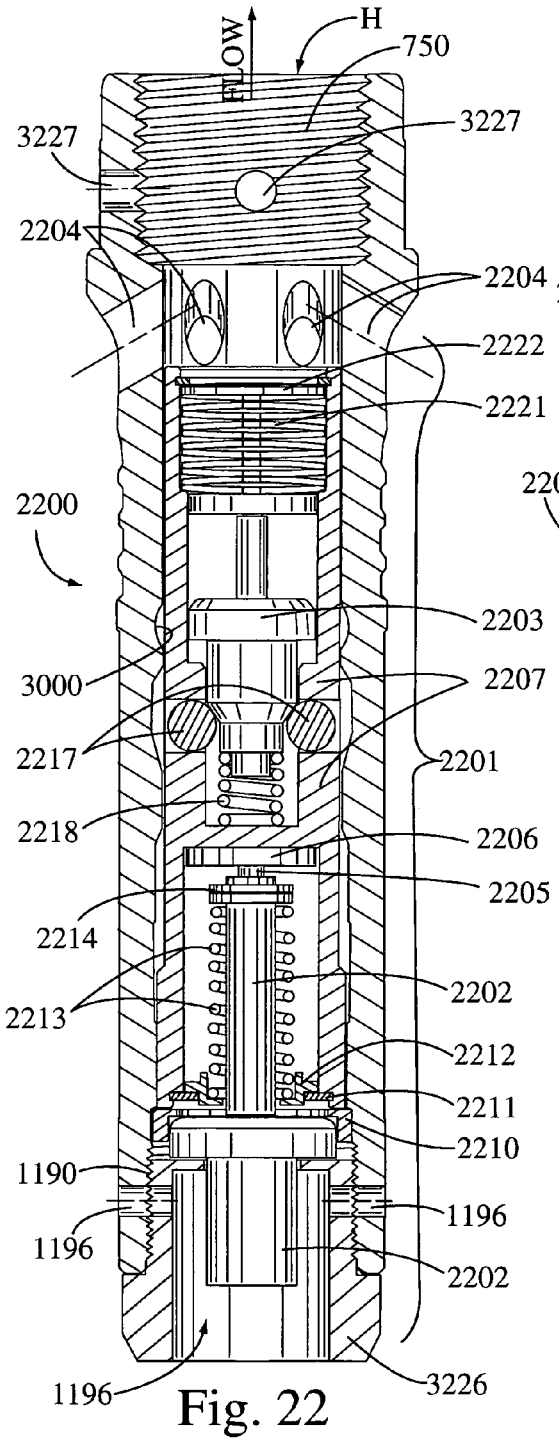
FIG. 22 is the FIG. 21 device in a passive mode shown in a sectional view.
Figure 23:
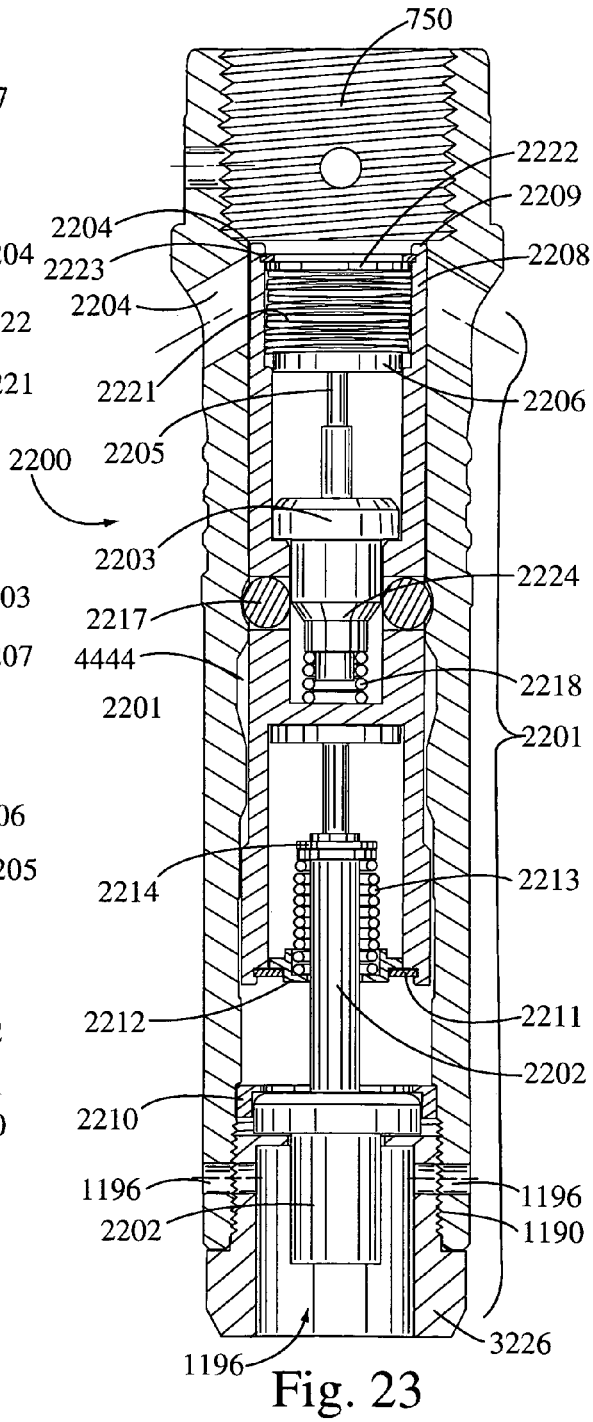
FIG. 23 is the FIG. 21 device in an actuated mode.

Referring next to FIGS. 21–23, a thermal actuated internal bypass plunger 2200 has a bypass assembly 2201 connected to any plunger 750. In general use, plunger 2200 is dropped downhole in a tube with thermal actuators 2202, 2203 in a passive mode as shown in FIG. 22. In this passive mode, bypass holes are open, thereby allowing fluid to pass up into the plunger 750 and through orifice H creating a flow FLOW.

Pusher actuator 2202 can be set at, for example, about 160° F. to push a piston 2205 up. A piston head 2206 engages a slide valve 2207 up, thereby closing holes 2204 with a valve gate segment 2208 which comprises a top rim seat 2209 which seats against plunger 750. A retaining ring 2210 remains stationary to secure the thermal actuator 2202 in place.

When the piston 2205 and piston head 2206 are actuated up as shown in FIG. 23 the slide valve gate segment 2208 moves up bringing with it members 2211–2218.

Snap rings 2211, 2214 secure a spring guide 2212 and a spring 2213. Spring guide 2212 draws spring 2213 up in FIG. 23.

Holes 2215 (see FIG. 21) in slide valve gate 2207 act as fluid flow holes. Holes 2216 each receive a locking ball 2217 (one embodiment has three of each type hole). Locking balls 2217 lock into locking groove 3000 on the inside of a valve casing 3001. Cooling fins 3002 (see FIG. 21) help dissipate heat to/from locking thermal actuator 2203.

Thermal actuator 2203 is usually set at about ambient ground level temperature, perhaps at about 70° F. When actuated, a locking piston 2220 pushes off a spring 2221, thereby forcing thermal actuator 2203 down as seen in FIG. 23. See also FIG. 21. Thermal actuator 2203 has a ramp 2224 which engages balls 2217, thereby pushing them into holes 2216 and groove 3000 as seen in FIG. 23. It is understood that thermal actuator 2203 may actuate on the way downhole before thermal actuator 2202 actuates.

FIGS. 21, 22, 23 show return spring 2218 forcing thermal actuator 2203 upward when it is in the passive mode. A washer 2222 secures spring 2221 seen in FIG. 21 against a snap ring 2223. All snaprings may have a locking groove, see 2225 for snap ring 2223.

An Allen screw lead hole 3225 is used to lock a cap 3226 in place. Locking ball holes 3227 are known in the art to house a ball and a locking ring. Indentations 4444 function to give the balls 2217 a snap action to unlock.

Figure 24:
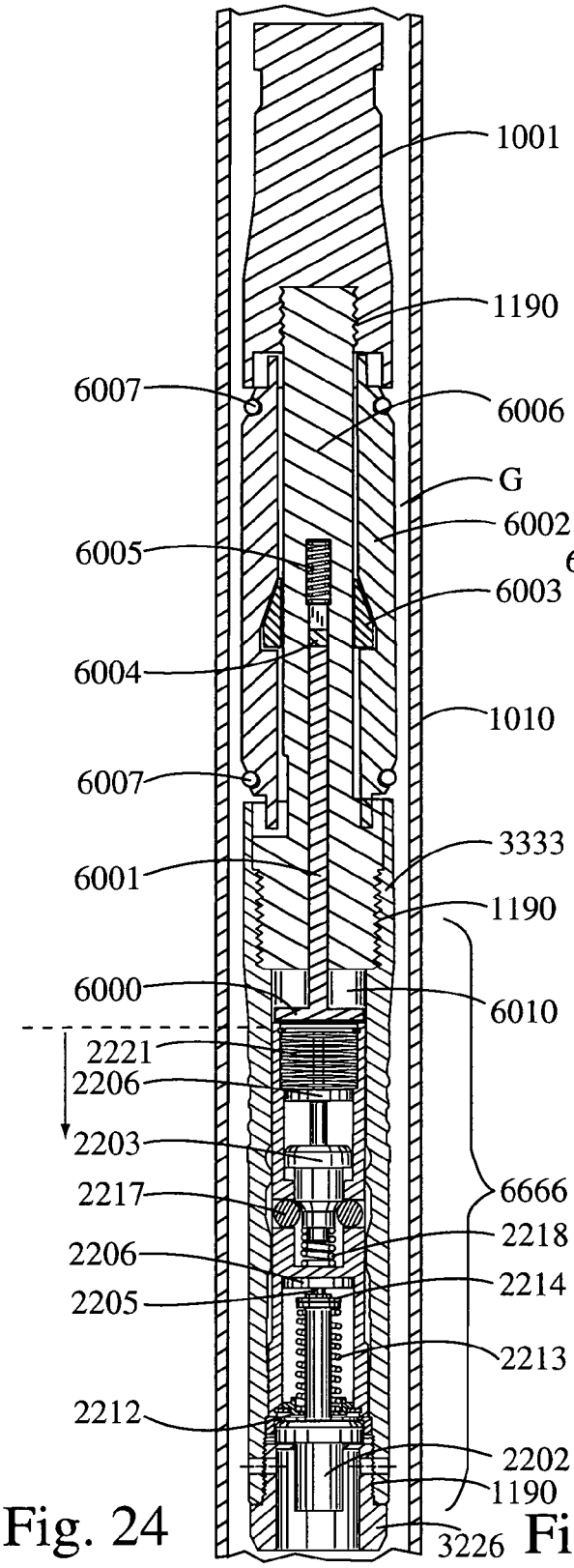
FIG. 24 is a sectional view of a pad plunger in a passive mode.
Figure 25:
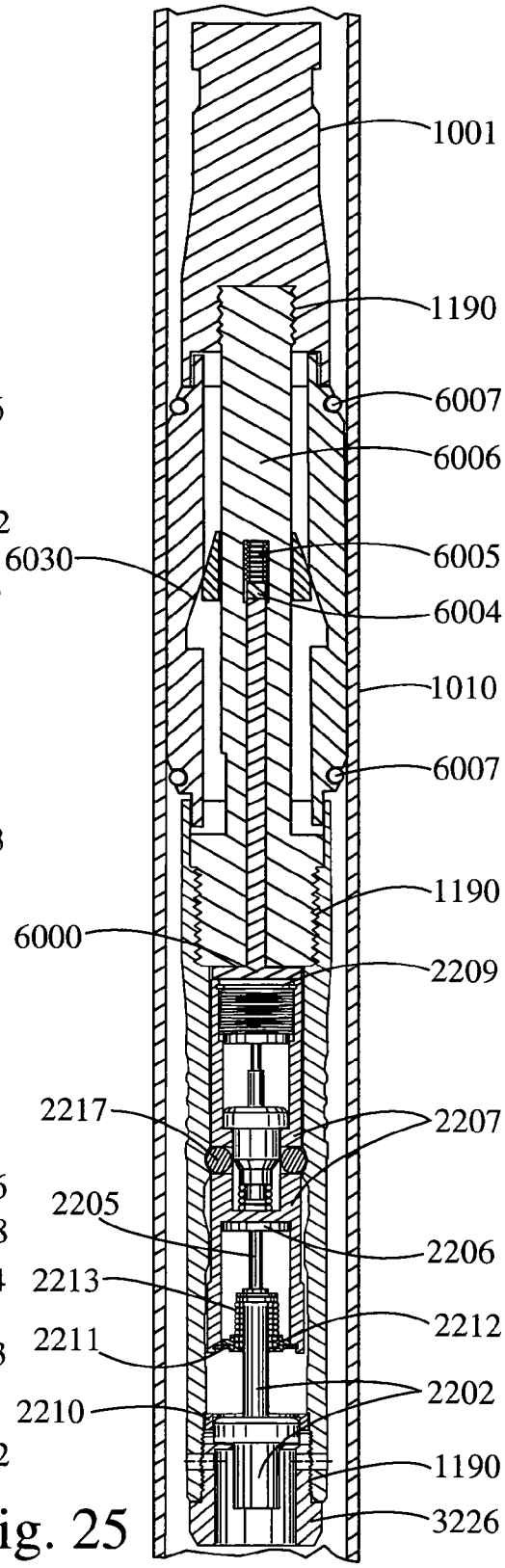
FIG. 25 is the FIG. 24 device in an actuated mode.

Referring next to FIGS. 24, 25, the elements below the dotted line are the same as assembly 2201 shown in FIG. 23. However, disclosed assembly 6666 eliminates holes 2204, 3227 in valve casing 3001. A casing 3333 screws onto a mandrel 6006. Assembly 6666 comprises a piston head 6000 resting on a top rim 2209. Space 6010 allows piston head 6000 to rise upon actuation of pusher actuator 2202. Piston head 6000 is attached to piston 6001 which engages transversely a key 6004 which in turn raises a circular wedge 6003 against an incline 6030 of pads 6002 (made of metal or rubber), thereby expanding pads 6002 to virtually eliminate gap G shown in FIG. 25. Springs (or O rings) 6007 act to close the pads back toward mandrel 6006 in the passive mode shown in FIG. 24. A return spring 6005 lowers piston 6001 and key 6004 to the passive position. Key 6004 is connected to circular wedge 6003 via a hole, and so wedge 6003 is lowered with key 6004 in FIG. 24.

It is understood in the art that a "pad" type plunger is an external bypass plunger, wherein upon a thermal actuated extension of the pads essentially closes the valve so as to create a tight seal against the downhole tubing for the rising of the plunger. Pads are known as blades or any member which extends away from a central mandrel to decrease the gap between the tubing and the plunger.

Although the present invention has been described with reference to disclosed embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. In an oil/gas production well having a downhole tube, said tube having a plunger which falls down the tube, an improvement to the plunger comprising:

a valve means functioning to regulate a fluid flow past the plunger; and a thermal actuator means functioning to control the valve means.

2. The apparatus of claim 1, wherein the valve means comprises a valve having a gate that closes a port from an external plunger surface to an internal channel in the plunger.

3. The apparatus of claim 1, wherein said thermal actuator further comprises an expandable material capable of sensing a range of ambient temperatures to cause an opening or closure of one or more plunger ports.

4. The apparatus of claim 1, wherein said thermal actuator further comprises an expandable material capable of sensing a range of ambient temperatures to cause an opening or closure of one or more plunger ports.

5. The apparatus of claim 1, wherein the valve further comprises an expandable means capable of modifying an outside diameter of the plunger.

6. A thermally actuated bypass plunger suited to travel downhole in a well tube, said bypass plunger comprising:

a body having a fluid channel therethrough;

a canister attachable to an end of the body;

said canister having a valve which provides a variable inlet port to the fluid channel of the body;

said valve having a moveable seat; and wherein ambient heat at a chosen temperature range activates a thermal actuator to move the valve seat to a closed position.

7. The plunger of claim 6, wherein the canister further comprises a threaded connector to mate with a threaded end of the body.

8. The plunger of claim 6, wherein a threaded male end of the body further comprises a spring to urge the valve toward an open or a closed position.

9. The plunger of claim 6, wherein the thermal actuator further comprises a piston capable of urging said valve seat to close said one or more inlet ports of said canister.

10. The plunger of claim 9, wherein the piston of said thermal actuator retracts in a selected temperature range to allow said valve seat to open said one or more inlet ports.

11. The plunger of claim 6 further comprising an insulator capable of shielding the thermal actuator from downhole heat of a chosen temperature range.

12. The plunger of claim 6 further comprising an insulator capable of retaining heat within the thermal actuator as the plunger rises.

13. The plunger of claim 11, wherein the chosen temperature range can be selected to coincide with plunger travel time.

14. The plunger of claim 6, wherein said thermal actuator can sense a range of ambient temperatures and cause an opening or closing of said one or more variable inlet ports.

15. The plunger of claim 14, wherein said opening or closing of said one or more variable inlet ports functions to slow the plunger's travel.

16. The plunger of claim 8, wherein the canister further comprises a screw means at its bottom for adjusting a seating tension of the valve against the spring.

17. In a downhole plunger, said plunger suited to lift formation liquids in a hydrocarbon well, an improvement to the plunger comprising:

a temperature dependent braking means functioning to react to a temperature rise and apply a braking force in a descent of the plunger.

18. The apparatus of claim 17, wherein the temperature dependent braking means further comprises a thermal actuator with a piston capable of closing a valve gate at a fluid port of a plunger body, thereby reducing a fluid flow through the plunger body.

19. The apparatus of claim 18, wherein the plunger body further comprises a canister housing the fluid port, the valve gate and the thermal actuator.

20. The apparatus of claim 17, wherein said temperature dependent braking means can react to a temperature drop and apply a braking force in an ascent of the plunger.

21. A thermal actuated bypass plunger comprising:

a body having a fluid channel therethrough;

said body having at least one port from an external surface thereof to the fluid channel;

a valve having a gate capable of closing the port; and a thermal actuator means functioning to activate the valve gate at a predetermined temperature range.

22. The plunger of claim 21, wherein the body further comprises a spring means functioning to move the valve gate to an open position at temperatures below the predetermined temperature range.

23. The plunger of claim 22, wherein the body further comprises a plug means functioning to allow replacement of one or more thermal actuator means.

24. The plunger of claim 23, wherein the body has a fluid channel from an exterior surface to the thermal actuator means.

25. The plunger of claim 21, wherein the valve gate further comprises a valve stem having a thermal actuated lock means functioning to lock the valve stem in the closed position via a second thermal actuator means.

26. The plunger of claim 21, wherein the thermal actuator means further comprises a plurality of thermal actuators.

27. A thermally actuated pad plunger comprising:

a body having at least one set of expandable pads encircling a segment of the body;

a central shaft mounted along a longitudinal axis of the body;

said central shaft having a plurality of cam extensions therefrom;

said cam extensions received by respective wedge members;

wherein a longitudinal movement of the central shaft pushes the wedge members outbound, thus expanding the set of pads; and wherein a thermal actuator urges the central shaft in the longitudinal movement at a selected temperature range.

28. The plunger of claim 27, wherein the body further comprises a return spring for the central shaft, and a second thermal actuator locks the central shaft in a closed mode.

29. A thermally actuated pad plunger comprising:

a body having at least one set of expandable pads encircling a segment of the body;

a central shaft mounted along a longitudinal axis of the body;

said central shaft having a plurality of cam extensions therefrom;

said cam extensions received by respective wedge members;

wherein a longitudinal movement of the central shaft pushes the wedge members outbound, thus expanding the set of pads;

wherein a thermal actuator urges the central shaft in the longitudinal movement at a selected temperature range; and said body further comprising an environmental sampler mounted in a cargo bay.

30. A thermally actuated plunger comprising:

a cylindrical body having two ends;

at least one of said ends having a connecting member to connect thereto a thermal actuator assembly;

said thermal actuator assembly comprising a thermal actuator to control a valve, said valve functioning to regulate a fluid flow past the plunger; and said cylindrical body further comprising an environmental sampler mounted in a cargo bay.

31. A method to obtain a temperature profile comprising the steps of:

providing a thermally actuated plunger with a chosen thermal actuator to cycle to a bottom of a well at a known time interval;

attaching a data logger to the thermally actuated plunger;

dropping the thermally actuated plunger to the bottom of the well;

retrieving the thermally actuated plunger; and retrieving a temperature profile from the data logger.

32. A thermal actuated brake assembly for a plunger, said brake assembly comprising:

a transverse hole in a body of a plunger;

a thermal actuator mounted in the transverse hole; and wherein a piston of the thermal actuator urges a brake pad outbound from the transverse hole at a selected temperature range.

33. A thermal actuated pad plunger comprising:

a body having a flexible, cylindrically shaped pad, surrounding a segment thereof;

said body having an internal core ledge which abuts an upper, internal segment of the flexible pad;

a wedge at a bottom segment of the flexible pad; and wherein a thermal actuator pushes the wedge up into the bottom segment of the flexible pad, thereby urging the upper internal segment of the flexible pad outbound along the internal core ledge, thus expanding the flexible cylindrically shaped pad.

34. An internal bypass plunger thermal actuated valve assembly, said assembly comprising:

a valve housing having a connector end to attach to either end of a plunger body;

a pusher thermal actuator having a piston which engages a moveable valve gate;

wherein upon a thermal actuation of the pusher thermal actuator, the piston moves the moveable valve gate to close a hole in the valve housing; and said moveable valve gate further comprising a locking thermal actuator which actuates at a lower temperature than the pusher thermal actuator, and has a piston which moves the actuator body against a locking ball to engage a locking groove in the valve housing, thereby maintaining the hole closed until the locking thermal actuator moves to a passive mode.

35. A thermal actuated pad plunger comprising:

a mandrel having at least a pair of spring loaded pads attached thereto;

said pads having an internal inclined surface;

a wedge engaged with the inclined surface;

a piston attached to the wedge;

an actuation assembly connected to the piston;

said actuation assembly having a pusher thermal actuator to drive a housing against the piston upon actuation, thereby driving the wedge against the included surface to extend the pads away from the mandrel; and said actuation assembly further comprising a locking thermal actuator having a piston means functioning to extend a lock into a locked position keeping the pads extended until the locking thermal actuator reaches a passive mode.

36. In an oil/gas production well having a downhole tube, said tube having a plunger which falls down the tube, an improvement to the plunger comprising:

a valve means functioning to regulate a fluid flow past the plunger; and a thermal actuator means functioning to control the valve means.

37. The apparatus of claim 36, wherein the valve means further comprises a valve having a gate that closes a port from an external plunger surface to an internal channel in the plunger.

38. The apparatus of claim 36, wherein the valve means comprises an expandable means functioning to modify an outside diameter of the plunger.

* * * * *